US005384585A

United States Patent [19]

Okumura

[11] Patent Number: 5,384,585

[45] Date of Patent: Jan. 24, 1995

[54] THERMAL STENCILING DEVICE

[75] Inventor: Takashi Okumura, Nagoya, Japan

[73] Assignee: Brother Kogyo Kabushiki Kaisha, Nagoya, Japan

[21] Appl. No.: 50,611

[22] Filed: Apr. 22, 1993

[30] Foreign Application Priority Data

May 27, 1992 [JP] Japan ..... 4-160304

[51] Int. Cl.[6] ..... B41J 2/335; B41C 1/055; B41C 1/14

[52] U.S. Cl. ..... 346/76 PH; 101/128.4; 101/114; 101/127; 101/129

[58] Field of Search ..... 101/114, 127, 128.4, 101/129; 400/120; 346/76 PH

[56] References Cited

U.S. PATENT DOCUMENTS

| | | | |
|---|---|---|---|
| 3,799,053 | 3/1974 | Rabelow | 101/125 |
| 4,630,074 | 12/1986 | Horinouchi et al. | 346/139 C |
| 5,216,951 | 6/1993 | Yokoyama et al. | 366/76 PH |

FOREIGN PATENT DOCUMENTS

| | | |
|---|---|---|
| 0159642 | 10/1985 | European Pat. Off. . |
| 0371457 | 6/1990 | European Pat. Off. . |
| 0500334A2 | 8/1992 | European Pat. Off. . |
| 63-17074 | 1/1988 | Japan . |
| 1-214456 | 8/1989 | Japan . |
| 0067133 | 3/1990 | Japan . |

*Primary Examiner*—Benjamin R. Fuller
*Assistant Examiner*—Huan Tran
*Attorney, Agent, or Firm*—Oliff & Berridge

[57] ABSTRACT

A thermal stenciling device in which the heat generating elements are sized to create optimal perforations based upon the type of stencil paper such that the ink does not bleed, produce back images or incompletely dry upon use and a method for determining the size of the heat generating elements. The size is based on desired dot pitches in both the main and sub-scanning directions which are a function of the stencil paper and ink.

4 Claims, 39 Drawing Sheets

COMPARISON OF GRADIENTS OF PERFORATION RATES TO APPLIED ENERGY IN STABLE REGION WITH DIFFERENT KINDS OF STENCIL PAPERS

THERMAL HEAD:4d
STENCIL PAPER:1a

THERMAL STENCILING DEVICE

BACKGROUND OF THE INVENTION

1. Field of the Invention

The invention relates to a thermal stenciling device having a thermal head constructed of a plurality of heat generating elements for perforating a heat-sensitive stencil paper.

2. Description of Related Art

In a conventional thermal stenciling device, it is known that a thermal head constructed of a plurality of heat generating elements is pressed against a thermoplastic resin film of a heat-sensitive stencil paper to thermally perforate the thermoplastic resin film.

FIG. 27 is a schematic illustration of such a thermal stenciling device in the prior art. Referring to FIG. 27, a heat-sensitive stencil paper 1, held between a pair of driven rollers 2, is fed by a platen roller 3 in a direction depicted by an arrow A, and is pressed by a plurality of heat generating elements 5 of a thermal head 40 against the platen roller 3. More specifically, a thermoplastic resin film formed on an upper side 1*a* of the heat-sensitive stencil paper 1 is pressed by the heat generating elements 5 of the thermal head 40, and the thermoplastic resin film of the stencil paper 1 is thermally perforated by the heat generating elements 5. In general, a thermal head such as employed in a facsimile apparatus is used as the thermal head 40.

FIG. 28 is a sectional view of the stencil paper 1. Referring to FIG. 28, the stencil paper 1 is constructed of a thermoplastic resin film 12, an adhesive layer 13 and a porous carrier 14. The thermoplastic resin film 12 and the porous carrier 14 are bonded together by the adhesive layer 13. The thermoplastic resin film 12 is formed as a polyethylene terephthalate (which will be hereinafter abbreviated as a PET film) having a thickness of 2 μm. Other materials may be used for the thermoplastic resin film 12, such as polypropylene and vinylidene chloride-vinyl chloride copolymer. The porous carrier 14 is formed as a porous thin sheet primarily composed of a natural fiber, such as Manila hemp, kozo or mitzumata; a synthetic fiber such as polyethylene terephthalate, polyvinyl alcohol or polyacrylonitrile; or a semisynthetic fiber such as rayon.

FIG. 3A is a schematic plan view of the thermal head 40. In FIG. 3A, a direction of feed of the stencil paper 1, that is, a direction of relative movement of the thermal head 40 is defined as a sub-scanning direction, and a direction perpendicular to the sub-scanning direction is defined as a main-scanning direction. The heat generating elements 5 each having a rectangular shape are arranged in line in the main-scanning direction of the thermal head 40. Two pattern layers 6 are connected to the opposite ends of each heat generating element 5 in the sub-scanning direction, so as to supply an electric power to each heat generating element 5.

When the electric power is supplied to the heat generating elements 5 of the thermal head 40, they generate heat. Accordingly, the temperature of the thermoplastic resin film 12 of the stencil paper 1 contacting the heat generating elements 5 under pressure is increased by the heat generated from the heat generating elements 5. When the temperature of the thermoplastic resin film 12 becomes higher than a shrinkage starting temperature Ta, the film 12 is melted to initially generate fine perforations and then enlarge them. Thereafter, when the supply of the electric power to the heat generating elements 5 is stopped, the heat of the heat generating elements 5 is radiated. Accordingly, the temperature of the thermoplastic resin film 12 is decreased to become lower than a shrinkage ending temperature Tb. As a result, the growth of the perforations formed through the thermoplastic resin film 12 is terminated, and the perforations are fixed.

In a facsimile apparatus, a feed rate of a recording paper in the sub-scanning direction is pre-established. Accordingly, the size of each heat generating element 5 of the thermal head 40 is determined based upon the pre-established feed rate.

In the conventional thermal head 40 for a facsimile, a ratio between a length b of each heat generating element 5 in the sub-scanning direction and a dot pitch Pb of the heat generating elements 5 in the sub-scanning direction is set to about 2:1, that is, the ratio b:Pb of approximately 2:1 is set to ensure constant print in the sub-scanning directing without white lines between adjacent dots that are meant to be connected. Accordingly, as shown in FIG. 3B, heat generating regions of the perforation dots to be formed on the stencil paper 1 overlap each other at D in the sub-scanning direction at given intervals.

However, in the conventional thermal stenciling device as mentioned above, there is possibility that a surface temperature of the thermoplastic resin film 12 at a gap portion between the adjacent dots in the main-scanning direction becomes higher than the shrinkage ending temperature Tb as a result of the thermal energy applied from the heat generating elements 5 to the stencil paper 1. In this case, the perforation generated at the center of each dot grows, and does not terminate in the gap portion but reaches the adjacent dot, thus forming a continuous perforation in the main-scanning direction. Further, since the overlap portion D exists between the adjacent dots in the sub-scanning direction, the above continuous perforation becomes continuous also in the sub-scanning direction.

As a result, in forming a solid image, a large, continuous perforation in both the main- and sub-scanning directions, with no gap portions, is formed on the stencil paper 1. Accordingly, the melted resin of the film 12, in a fluidic condition, becomes entangled with the porous carrier 14 to again form a thickened resin film or bulk. The resin film or bulk thus formed causes the formation of an undue white image portion in a black image portion in printing resulting in the appearance of so-called "Japanese paper crimp" in a printed image.

Further, a quantity of ink to be transferred through the large perforation onto a printing paper is larger than that through other image portions. Accordingly, the phenomena of undrying, bleeding and back imaging on the printing paper are frequent in the solid image. Further, character images and line images are also formed by perforation dots continuous in both the main-and sub-scanning directions, so that the phenomena of undrying, bleeding and back imaging become frequent also in character images and the line images.

SUMMARY OF THE INVENTION

It is accordingly an object of the invention to provide a thermal stenciling device which can obtain a faithful and stable print image for every original image, suppress and stabilize the ink transfer quantity, and reduce and stabilize the phenomena of undrying, bleeding and back imaging.

According to the invention, there is provided a thermal stenciling device comprising a thermal head constructed of a plurality of heat generating elements arranged in line in a main-scanning direction, the heat generating elements for being pressed against a thermoplastic resin film bonded to a porous carrier constituting a heat-sensitive stencil paper and to be relatively moved in a sub-scanning direction perpendicular to the main-scanning direction to form a plurality of dot perforations through the thermoplastic resin film of the heat-sensitive stencil paper by heat of the heat generating elements; wherein each of the heat generating elements of the thermal head has a size to be decided by the following four formulas:

$$A/a:B/b=1:\alpha(\alpha=0.6 \text{ to } 1.0)$$

$$A/a=\beta(\beta=0.8 \text{ to } 1.2)$$

$$A+C=Pa$$

$$B+C=Pb$$

where,

A: length of each perforation in the main-scanning direction;

a: length of each heat generating element in the main-scanning direction;

B: length of each perforation in the sub-scanning direction;

b: length of each heat generating element in the sub-scanning direction;

$\alpha$: ratio of perforation rate in the sub-scanning direction to perforation rate in the main-scanning direction;

$\beta$: the perforation rate in the main-scanning direction;

C: length of a gap as an nonperforated portion between the adjacent dot perforations in the main-scanning direction and the sub-scanning direction;

Pa: dot pitch in the main-scanning direction; and

Pb: dot pitch in the sub-scanning direction

In the thermal stenciling device according to the invention having the above-mentioned structure, the size of each heat generating element constituting the thermal head is decided by the above four formulas. Accordingly, the growth of each perforation can be stopped in the gap between the adjacent dots in the main- and sub-scanning directions, so that the perforation dots become independent of each other in the main- and sub-scanning directions. Accordingly, an ink transfer quantity can be suppressed to thereby reduce the phenomena of undrying, bleeding and back imaging. Further, since a white image portion to be formed at the gap between the adjacent perforation dots is blackened by a bleeding effect of the ink, a faithful character image in accordance with an original image can be formed without broadening. Further, since the perforation rate is stable, the ink transfer quantity can be stabilized to suppress the phenomena of undrying, bleeding and back imaging and form a constantly stable character image.

As described above, the thermal stenciling device according to the present invention can obtain a faithful and stable print image for every original image, suppress and stabilize the ink transfer quantity, and reduce and stabilize the phenomena of undrying, bleeding and back imaging.

Other objects and features of the invention will be more fully understood from the following detailed description and appended claims when taken with the accompanying drawings.

BRIEF DESCRIPTION OF THE DRAWINGS

The invention will be explained with reference to the drawings in which.

DESCRIPTION OF THE PREFERRED EMBODIMENTS

Figure 1A:
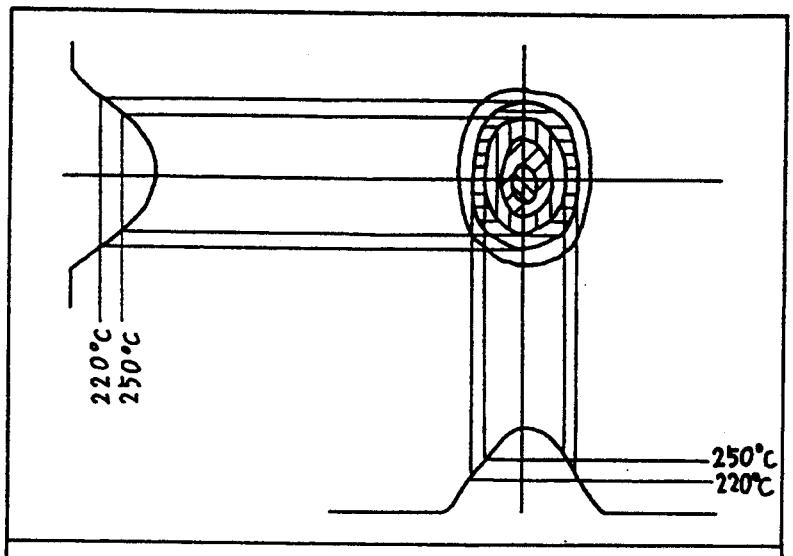
FIGS. 1A, 1B and 1C are drawings of photographic views illustrating the results of measurement of a surface temperature distribution of heat generating elements having different sizes in three kinds of thermal heads according to this invention.

There will now be described a preferred embodiment of the invention with reference to the drawings, in which the same parts as those in the prior art are designated by the same reference numerals, and the explanation thereof will be omitted hereinafter.

Figure 2:
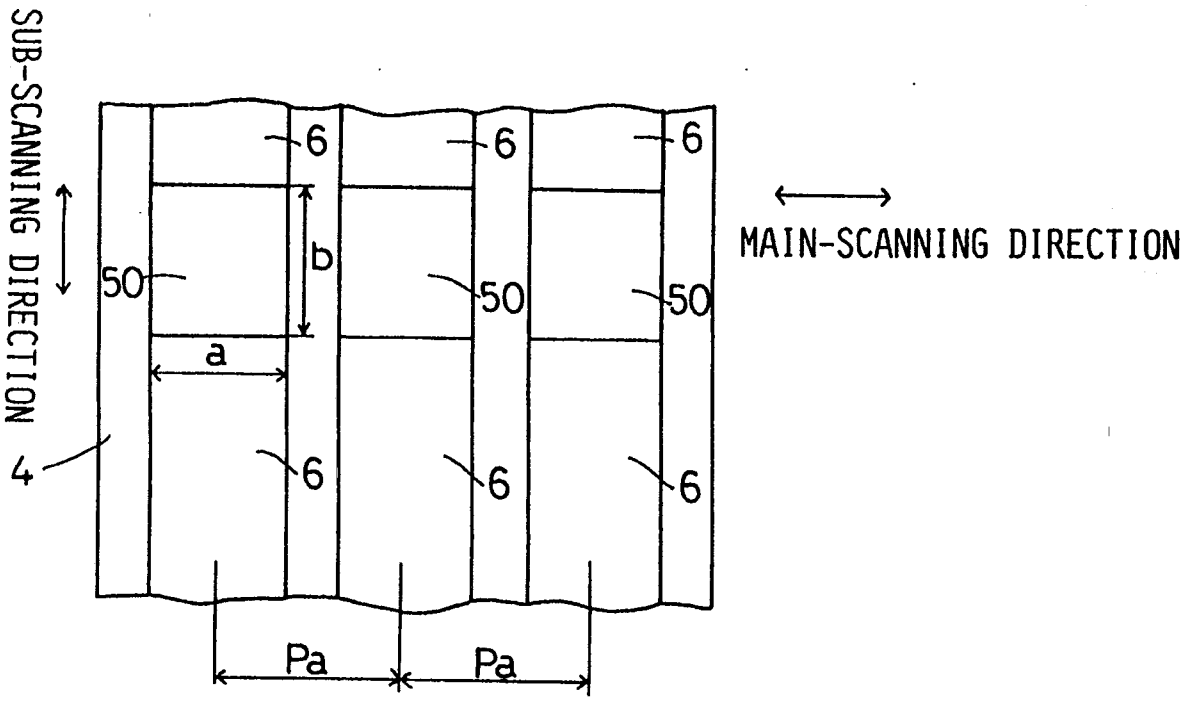
FIG. 2 a schematic plan view of a part of a thermal head according to the invention.
Figure 3A:
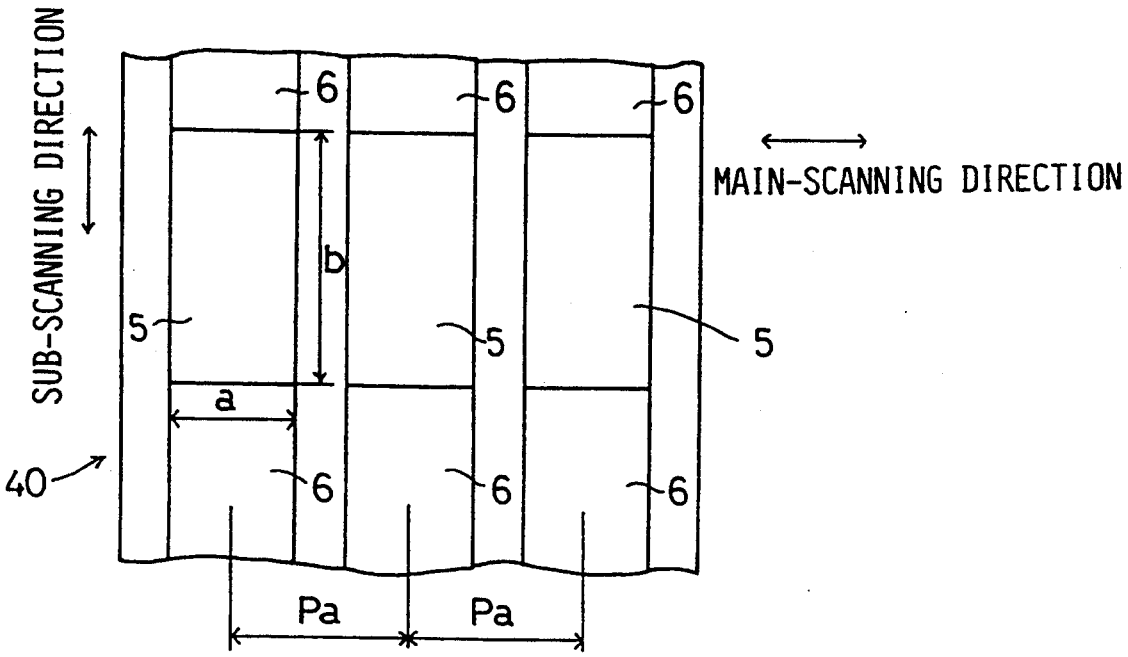
FIG. 3A is a schematic plan view of a part of a thermal head in the prior art.
Figure 3B:
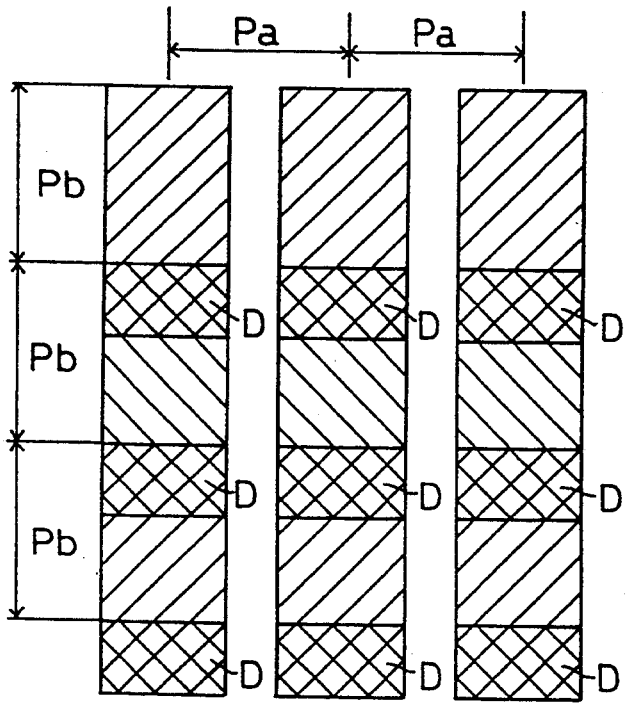
FIG. 3B is a schematic illustration of a dot pitch in a sub-scanning direction of the thermal head shown in FIG. 3A.
Figure 4A:
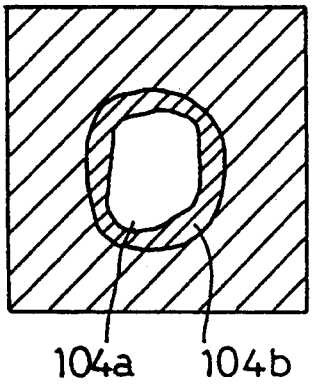
FIGS. 4A, 4B, 4C, 4D, 4E and 4F are drawings of partial photographic views illustrating the results of observation, with use of an optical microscope, of two kinds of heat-sensitive stencil papers perforated by the three kinds of thermal heads shown in FIGS. 1A to 1C.
Figure 4B:
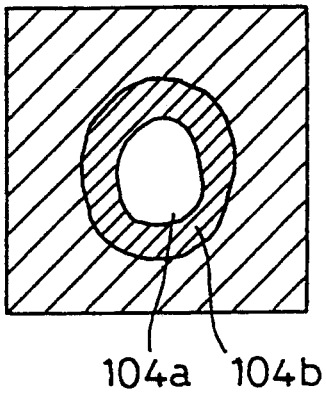
Figure 4C:
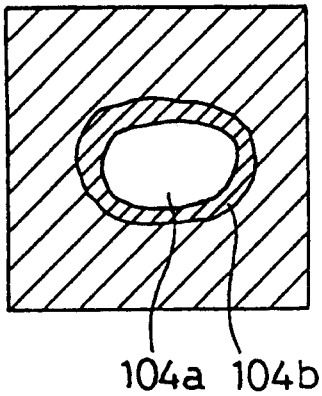
Figure 4D:
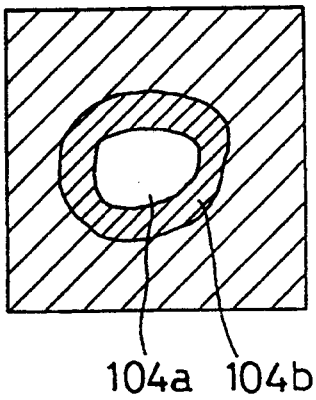
Figure 4E:
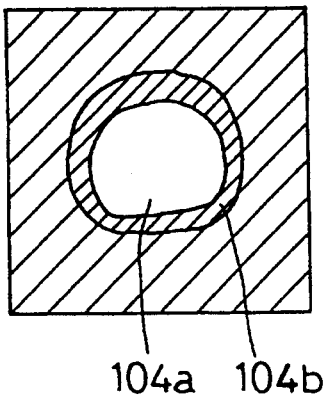
Figure 4F:
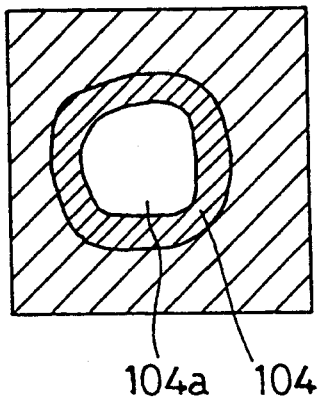

FIG. 2 is a schematic plan view of a thermal head 4 used in the thermal stenciling device in the preferred embodiment. As shown in FIG. 2, a plurality of heat generating elements 50 each provided between pattern layers 6 are arranged in line at a dot pitch Pa in a main-scanning direction.

In this preferred embodiment, the dot pitch Pa in the main-scanning direction is equal to a dot pitch Pb in a sub-scanning direction.

There will now be described a process of introduction of Formulas 1 to 4 which decide the size of each heat generating element 50 in this preferred embodiment. In the following description, reference symbols are as follows:

A: length of perforation in the main-scanning direction;

a: length of heat generating element in the main-scanning direction;

B: length of perforation in the sub-scanning direction;

b: length of heat generating element in the sub-scanning direction;

$\alpha$: ratio of perforation rate in the sub-scanning direction to perforation rate in the main-scanning direction;

$\beta$: perforation rate in the main-scanning direction;

C: length of gap as imperforated portion between adjacent dot perforations in the main-scanning direction and the sub-scanning direction;

Pa: dot pitch in the main-scanning direction; and

Pb: dot pitch in the sub-scanning direction.

Formula 1 is presented as follows:

$$A/a:B/b=1:\alpha(\alpha=0.6 \text{ to } 1.0) \quad (1)$$

The process of the introduction of Formula 1 will now be described.

Using thin-film type thermal heads, designated as 4*a*, 4*b* and 4*c* and each having a resolution of 300 DPI, a surface temperature distribution of each heat generating element 50 of the thermal heads 4*a* to 4*c* was measured. Each of the thermal heads 4*a* to 4*c* was mounted to the thermal stenciling device, and stenciling was performed on heat-sensitive stencil papers designated as 1*a* and 1*d*.

Thermal head 4*a*:

Dot size ($\mu$m): 50 (main-scanning direction)×78 (sub-scanning direction);

Dot area ($\mu m^2$): 3900;

Resistance ($\Omega$): 1000;

Applied power (w/mm$^2$): 40 (40 w×3900 $\mu m^2$=0.156 watts per dot (w/dot)); and Applied energy (mJ/mm$^2$): 60.

Thermal head 4*b*:

Dot size ($\mu$m): 69 (main-scanning direction)×56 (sub-scanning direction);

Dot area ($\mu m^2$): 3864;

Resistance ($\Omega$): 497;

Applied power (w/mm$^2$): 40 (0.155 w/dot); and

Applied energy (mJ/mm$^2$): 60.

Thermal head 4*c*:

Dot size ($\mu$m): 67 (main-scanning direction)×79 (sub-scanning direction);

Dot area ($\mu m^2$): 5293;

Resistance ($\Omega$): 683;

Applied power (w/mm$^2$): 40 (0.212 w/dot); and

Applied energy (mJ/mm$^2$): 60.

Stencil paper 1*a*:

Thermoplastic resin film:

Material: polyethylene terephthalate (PET),

Thickness ($\mu$m): 1.8,

Melting point (°C.): 214; and

Porous carrier:

Material: PET fiber,

Thickness ($\mu$m): 40.

Stencil paper 1*d*:

Thermoplastic resin film:

Material: polyethylene terephthalate (PET),

Thickness ($\mu$m): 1.8,

Melting point (°C.): 252; and

Porous carrier:

Material: Manila hemp,

Thickness ($\mu$m): 38.

Figure 1B:
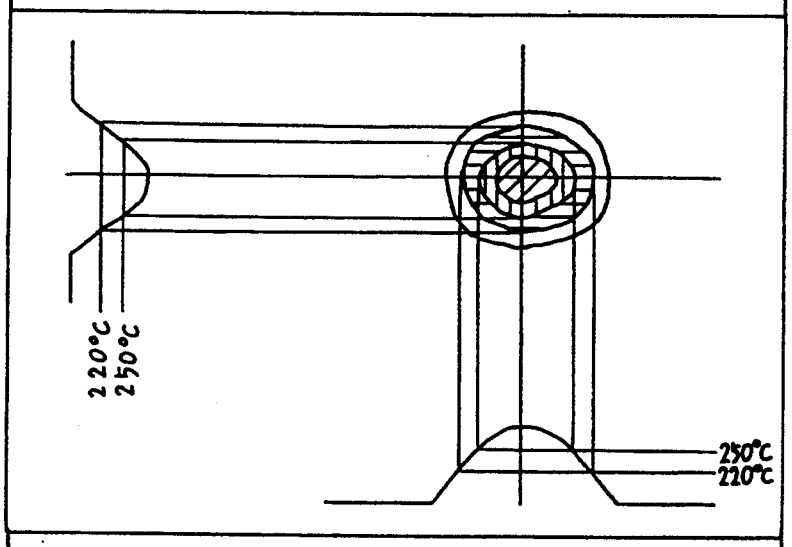
Figure 1C:
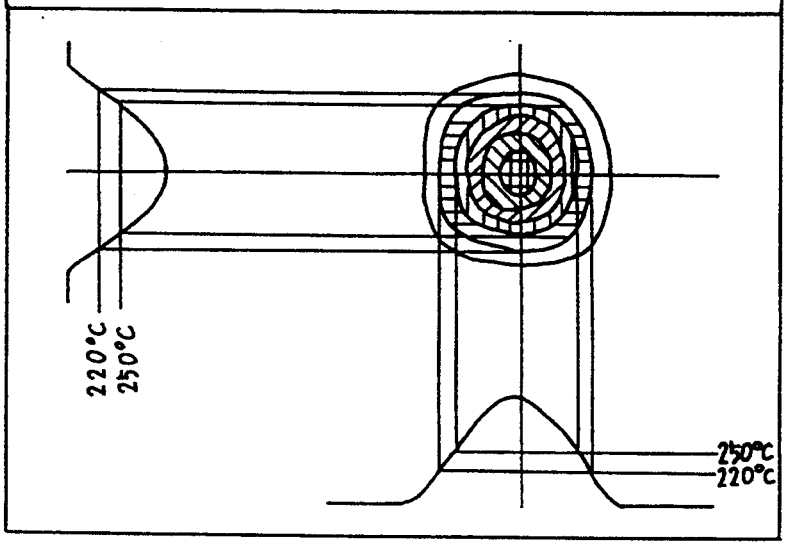

The results of measurement of the surface temperature distribution of each heat generating element 50 of the thermal heads 4*a* to 4*c* are shown in FIGS. 1A to 1C, respectively, and the results of observation, with use of an optical microscope, of the stencil papers 1*a* and 1*d*, in partial view, perforated by the thermal heads 4*a* to 4*c* are shown in FIGS. 4A to 4F, wherein FIGS. 4A, 4B, 4C, 4D, 4E and 4F correspond to the combinations of (4*a*-1*a*), (4*a*-1*d*), (4*b*-1*a*), (4*b*-1*d*), (4*c*-1*a*) and (4*c*-1*d*), respectively. In FIGS. 4A to 4F, reference numeral 104*a* designates a perforation, and reference numeral 104*b* designates a bank formed around the perforation 104*a*.

As apparent from FIGS. 1A to 1C and FIGS. 4A to 4F, the shapes of the perforations of the stencil papers 1*a* and 1*d* almost agree with the regions of the surface temperature distributions near 220°–250° C. of each heat generating element of the thermal heads 4*a* to 4*c*. The above results were numerically examined to obtain the following results for the various combination of thermal heads and stencil papers:

Thermal head 4*a*-stencil paper 1*a*:

Dot size ($\mu$m) D: 50 (main-scanning direction)×78 (sub-scanning direction);

220° C. distribution region ($\mu$m) T: 56 (main-scanning direction)×77 (sub-scanning direction);

Perforation rate T/D: 1.12 (main-scanning direction)×0.99 (sub-scanning direction);

Ratio of perforation rate in the sub-scanning direction to perforation rate in the main-scanning direction: $\alpha t=0.88$;

Perforation rate of the stencil paper: 1.04 (main-scanning direction)×0.80 (sub-scanning direction); and Ratio of perforation rate in the sub-scanning direction to perforation rate in the main-scanning direction: $\alpha=0.77$ Thermal head 4*a*-stencil paper 1*d*:

Dot size ($\mu$m) D: 50 (main-scanning direction)×78 (sub-scanning direction);

250° C. distribution region ($\mu$m) T: 46 (main-scanning direction)×60 (sub-scanning direction);

Perforation rate T/D: 0.92 (main-scanning direction)×0.77 (sub-scanning direction);

Ratio of perforation rate in the sub-scanning direction to perforation rate in the main-scanning direction: $\alpha t=0.84$;

Perforation rate of the stencil paper: 1.02 (main-scanning direction)×0.69 (sub-scanning direction); and
Ratio of perforation rate in the sub-scanning direction to perforation rate in the main-scanning direction: $\alpha=0.68$.

Thermal head 4b-stencil paper 1a:
Dot size (μm) D: 69 (main-scanning direction)×56 (sub-scanning direction);
220° C. distribution region (μm) T: 70 (main-scanning direction)×56 (sub-scanning direction);
Perforation rate T/D: 1.01 (main-scanning direction)×1.00 (sub-scanning direction);
Ratio of perforation rate in the sub-scanning direction to perforation rate in the main-scanning direction: $\alpha t=0.99$;
Perforation rate of the stencil paper: 0.89 (main-scanning direction)×0.87 (sub-scanning direction); and
Ratio of perforation rate in the sub-scanning direction to perforation rate in the main-scanning direction: $\alpha=0.98$.

Thermal head 4b-stencil paper 1d:
Dot size (μm) D: 69 (main-scanning direction)×56 (sub-scanning direction);
250° C. distribution region (μm) T: 56 (main-scanning direction)×42 (sub-scanning direction);
Perforation rate T/D: 0.81 (main-scanning direction)×0.75 (sub-scanning direction);
Ratio of perforation rate in the sub-scanning direction to perforation rate in the main-scanning direction: $\alpha t=0.92$;
Perforation rate of the stencil paper: 0.76 (main-scanning direction)×0.59 (sub-scanning direction); and
Ratio of perforation rate in the sub-scanning direction to perforation rate in the main-scanning direction: $\alpha=0.78$.

Thermal head 4c-stencil paper 1a:
Dot size (μm) D: 67 (main-scanning direction)×79 (sub-scanning direction);
220° C. distribution region (μm) T: 81 (main-scanning direction)×84 (sub-scanning direction);
Perforation rate T/D: 1.21 (main-scanning direction)×1.06 (sub-scanning direction);
Ratio of perforation rate in the sub-scanning direction to perforation rate in the main-scanning direction: $\alpha t=0.88$;
Perforation rate of the stencil paper: 1.12 (main-scanning direction)×0.83 (sub-scanning direction); and
Ratio of perforation rate in the sub-scanning direction to perforation rate in the main-scanning direction: $\alpha=0.74$.

Thermal head 4c-stencil paper 1d:
Dot size (μm) D: 67 (main-scanning direction)×79 (sub-scanning direction);
250° C. distribution region (μm) T: 67 (main-scanning direction)×67 (sub-scanning direction);
Perforation rate T/D: 1.00 (main-scanning direction)×0.85 (sub-scanning direction);
Ratio of perforation rate in the sub-scanning direction to perforation rate in the main-scanning direction: $\alpha t=0.85$;
Perforation rate of the stencil paper: 1.00 (main-scanning direction)×0.74 (sub-scanning direction); and
Ratio of perforation rate in the sub-scanning direction to perforation rate in the main-scanning direction: $\alpha=0.74$.

The perforation rate of the stencil paper for the main-scanning direction is the ratio of the width of the dot formed divided by the width of the heat generating element, i.e., A/a, and for the sub-scanning direction is the ratio of the height of the dot formed divided by the height of the heat generating element, i.e., B/b.

It is understood from the above results that the low level of the perforation rate of the stencil paper in the sub-scanning direction is dependent on the surface temperature distribution of each heat generating element 50.

Figure 5:
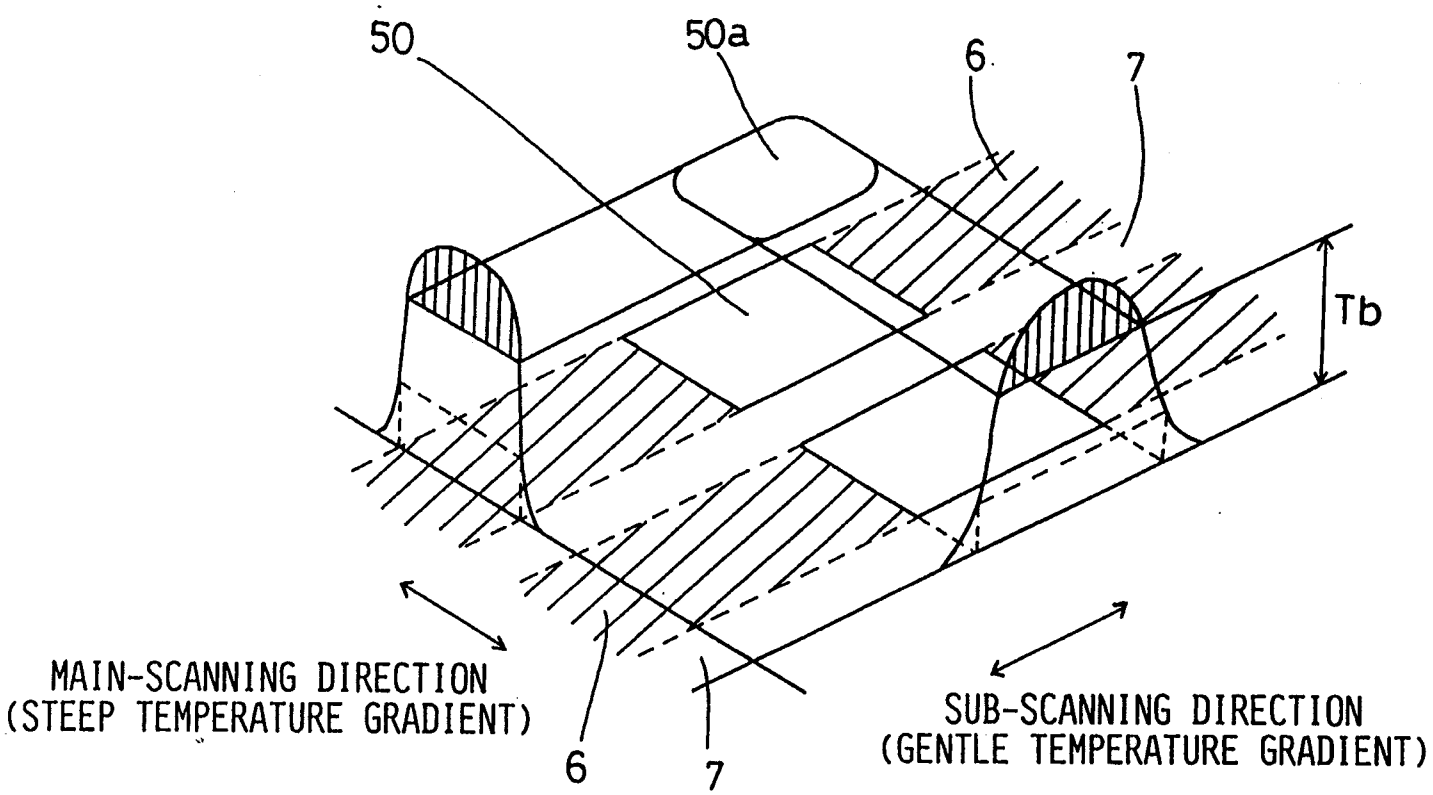
FIG. 5 is a perspective view illustrating a surface temperature distribution of each heat generating element in the thermal head according to the invention.

As shown in FIG. 5, each heat generating element 50 is surrounded by insulating layers 7 in the main-scanning direction and by the pattern layers 6 in the sub-scanning direction. The heat generated from each heat generating element 50 is hard to radiate in the main-scanning direction, and is easily radiated in the sub-scanning direction. Therefore, a temperature gradient of each heat generating element 50 in the main-scanning direction is steep and a temperature gradient of each heat generating element 50 in the sub-scanning direction is gentle. As a result, it is easy to stably transmit the heat to the heat-sensitive stencil paper 1 in the main-scanning direction and is hard to transmit the heat to the stencil paper 1 in the sub-scanning direction, thus causing the difference in perforation rate of the stencil paper 1 between the main-scanning direction and the sub-scanning direction.

With the applied energy in a stable region to be hereinafter described, the ratio of the perforation rate in the sub-scanning direction to the perforation rate in the main-scanning direction falls in the range of 0.6 to 1.0 regardless of the difference in the size of each heat generating element of the thermal head 4 and the difference in melting point of the stencil paper 1. Thus, the size of each heat generating element of the thermal head 4 is decided so as to satisfy Formula 1.

Formula 2 is presented as follows:

$$A/a=\beta(\beta=0.8 \text{ to } 1.2) \quad (2)$$

The process of introduction of Formula 2 will now be described.

First, the correlation between the perforation rate and the applied energy in relation to a difference in kind of the stencil paper 1 will be examined.

The following thin-film type thermal head 4d having a resolution of 300 DPI was mounted to the thermal stenciling device and stenciling was performed on the heat-sensitive stencil papers designated as 1a to 1e.

Thermal head 4d:
Dot size (μm): 67 (main-scanning direction)×59 (sub-scanning direction);
Dot area ($\mu m^2$): 3953;
Resistance (Ω): 526;
Applied power ($w/mm^2$): 40 (0.158 w/dot); and
Applied energy ($mJ/mm^2$): 5 to 80.

Stencil paper 1a:
Thermoplastic resin film:
Material: polyethylene terephthalate (PET),
Thickness (μm): 1.8,
Melting point (°C.): 214, and
Porous carrier:
Material: PET fiber,
Thickness (μm): 40.

Stencil paper 1b:
Thermoplastic resin film:
Material:polyethylene terephthalate (PET),
Thickness (μm): 1.8,
Melting point (°C.): 214; and
Porous carrier:

Material: hemp fiber,
Thickness (μm): 47.
Stencil paper 1c:
Thermoplastic resin film:
Material:polyethylene terephthalate (PET),
Thickness (μm): 1.5,
Melting point (°C.): 252; and
Porous carrier:
Material: Manila hemp,
Thickness (μm): 38.
Stencil paper 1d:
Thermoplastic resin film:
Material:polyethylene terephthalate (PET),
Thickness (μm): 1.8,
Melting point (°C.): 252; and
Porous carrier:
Material: Manila hemp,
Thickness (μm): 38.
Stencil paper 1e:
Thermoplastic resin film:
Material:polyethylene terephthalate (PET),
Thickness (μm): 1.8,
Melting point (°C.): 258; and
Porous carrier:
Material: Manila hemp,
Thickness (μm): 43.

The relationship between the applied energy and the perforation rate in the main-scanning direction and the sub-scanning direction of the stencil papers 1a to 1e is shown in FIGS. 6A to 10B. The SN ratio is determined as described in "Introduction to Quality Engineering", by Genichi Taguchi, Asian Productivity Organization, 1986, pgs. 169–170. The SN (S/N) ratio $\eta$ is determined as follows:

$$\eta = 10 \log \frac{\frac{1}{n}(S_m - V_e)}{V_e}$$

and expressed as decibels (db) where:

$$S_m = \frac{(X_1 + X_2 + \ldots + X_n)^2}{n}$$

$$V_e = \frac{1}{n-1}(\Sigma X_i^2 - S_m); \text{ and}$$

$X_{i=1,\ldots,n}$=measured values for the perforation rates.

Figure 6A:
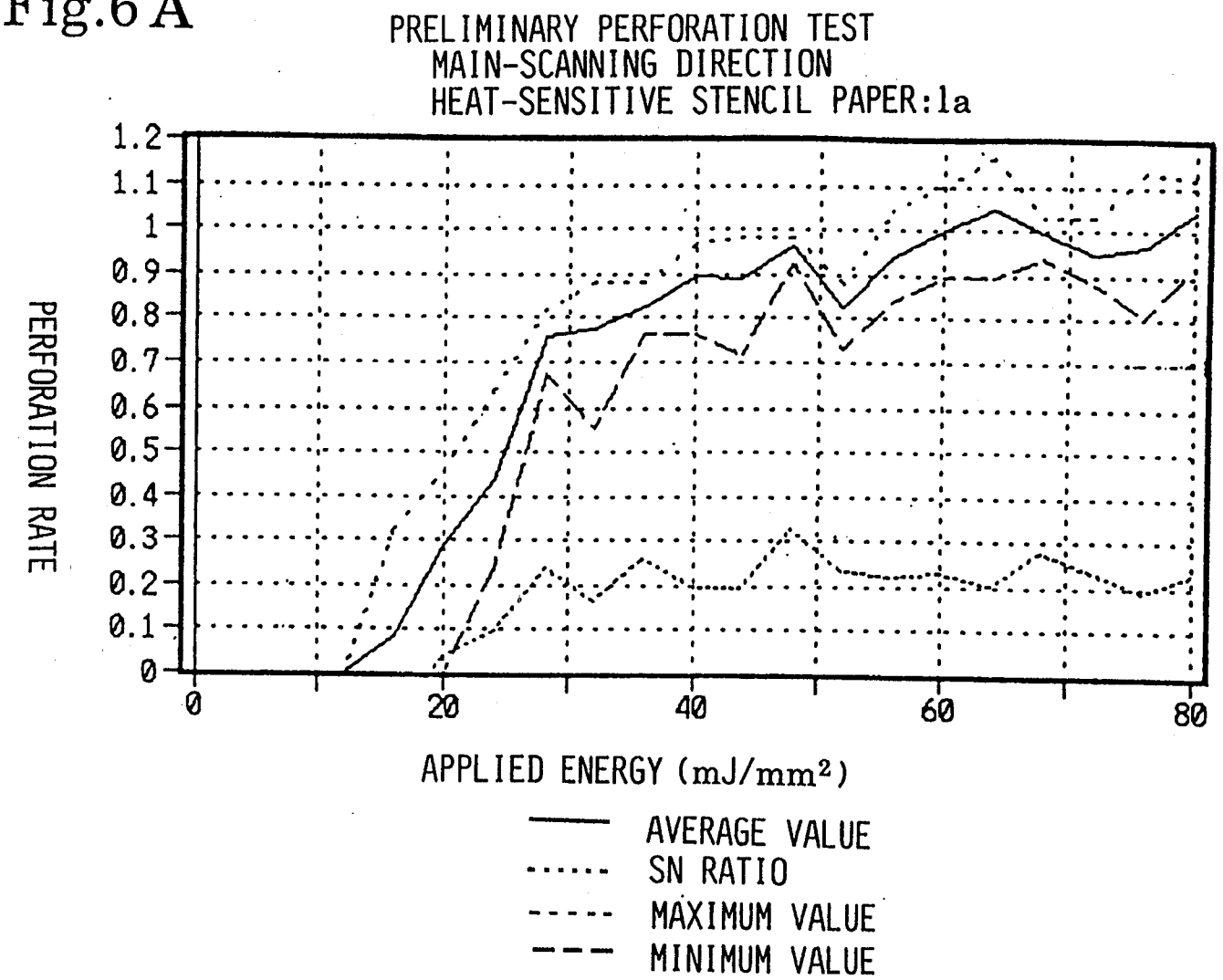
FIGS. 6A, 6B, 7A, 7B, 8A, 8B, 9A, 9B, 10A and 10B are graphs showing the relationship between an applied energy and a perforation rate in main- and sub-scanning directions of five kinds of heat-sensitive stencil papers according to the invention.
Figure 6B:
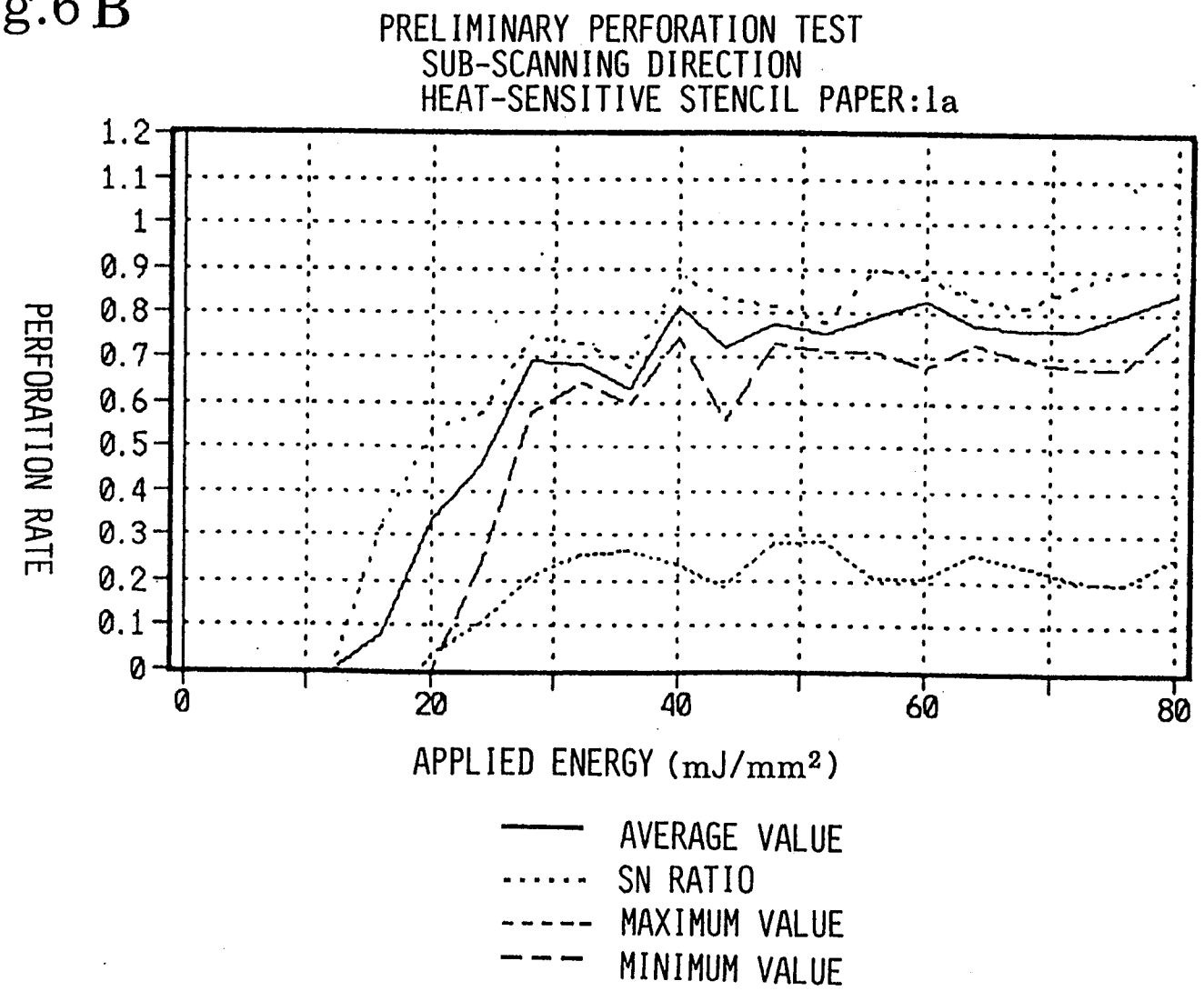

As is apparent from FIGS. 6A and 6B, the perforation rates in both the main-scanning direction and the sub-scanning direction of the stencil paper 1a are high, and enter a stable region with less variation at an applied energy of about 40 mJ/mm2. The perforation rate in the sub-scanning direction is lower than that in the main-scanning direction as mentioned above, and the gradient in the sub-scanning direction in the stable region is much gentler than that in the main-scanning direction.

Figure 7A:
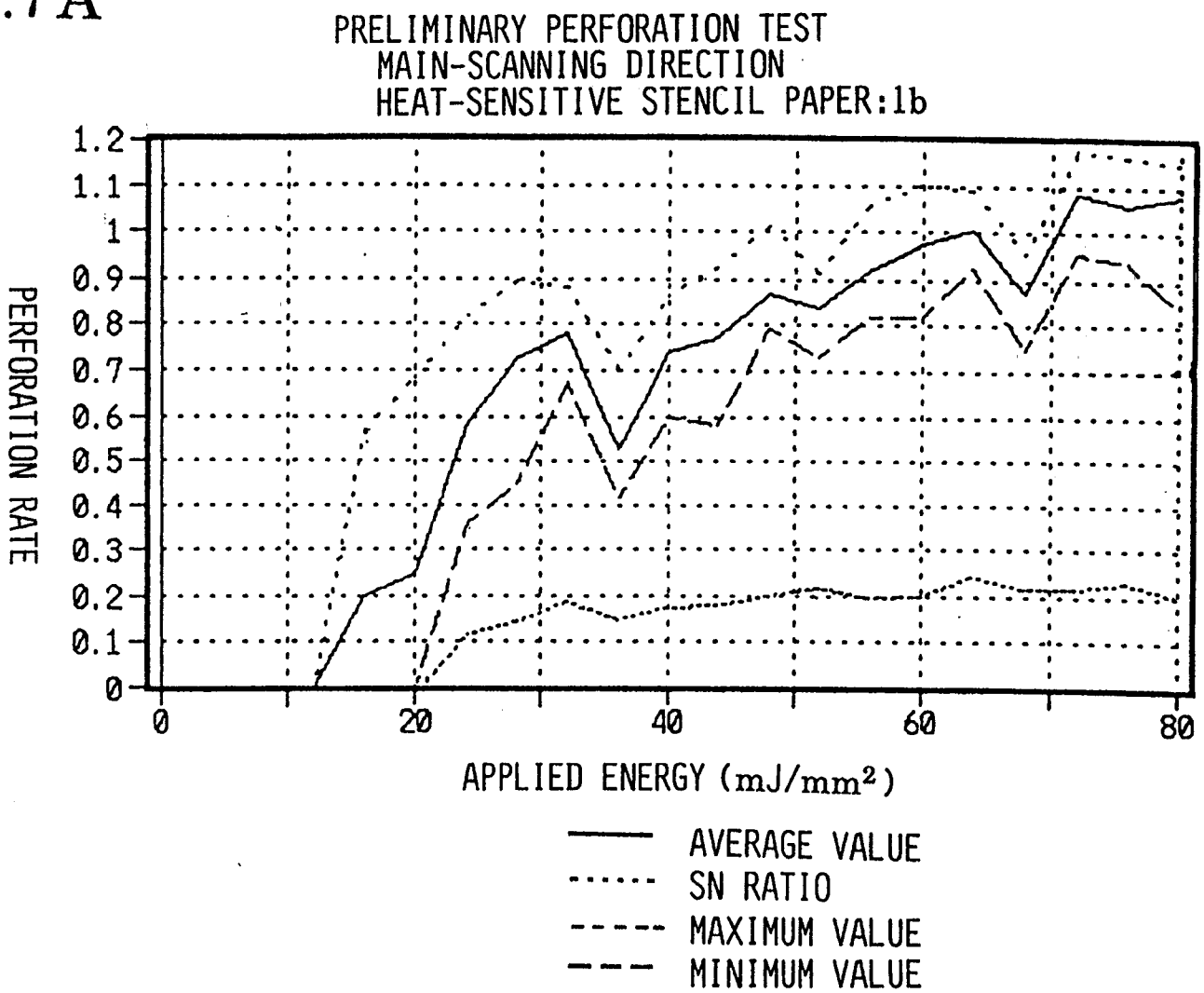
Figure 7B:
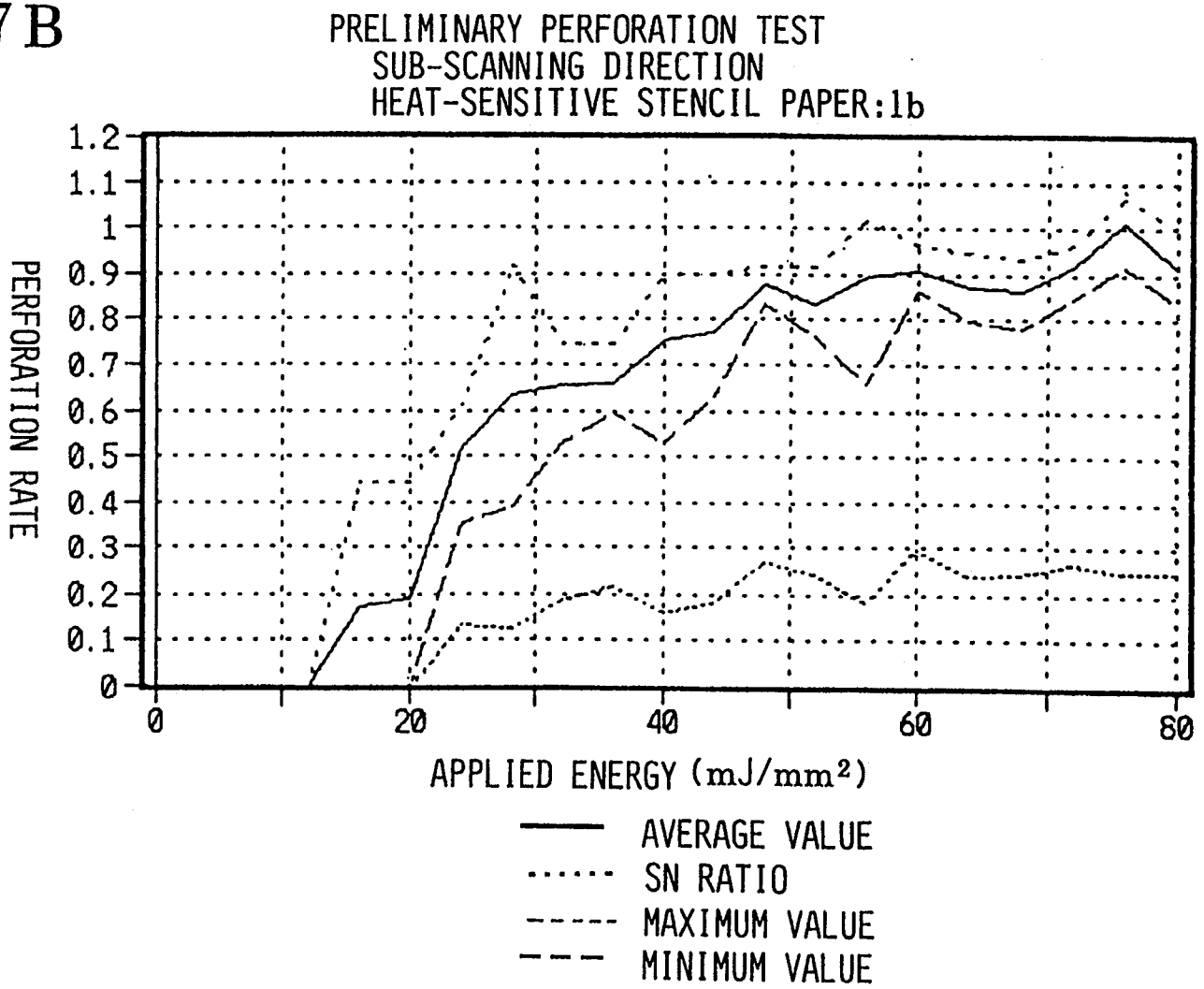

As is apparent from FIGS. 7A and 7B, the perforation rates in both the main-scanning direction and the sub-scanning direction of the stencil paper 1b are high and enter a stable region with less variation at an applied energy of about 40 mJ/mm2. The perforation rate in the sub-scanning direction is lower than that in the main-scanning direction as mentioned above.

Figure 8A:
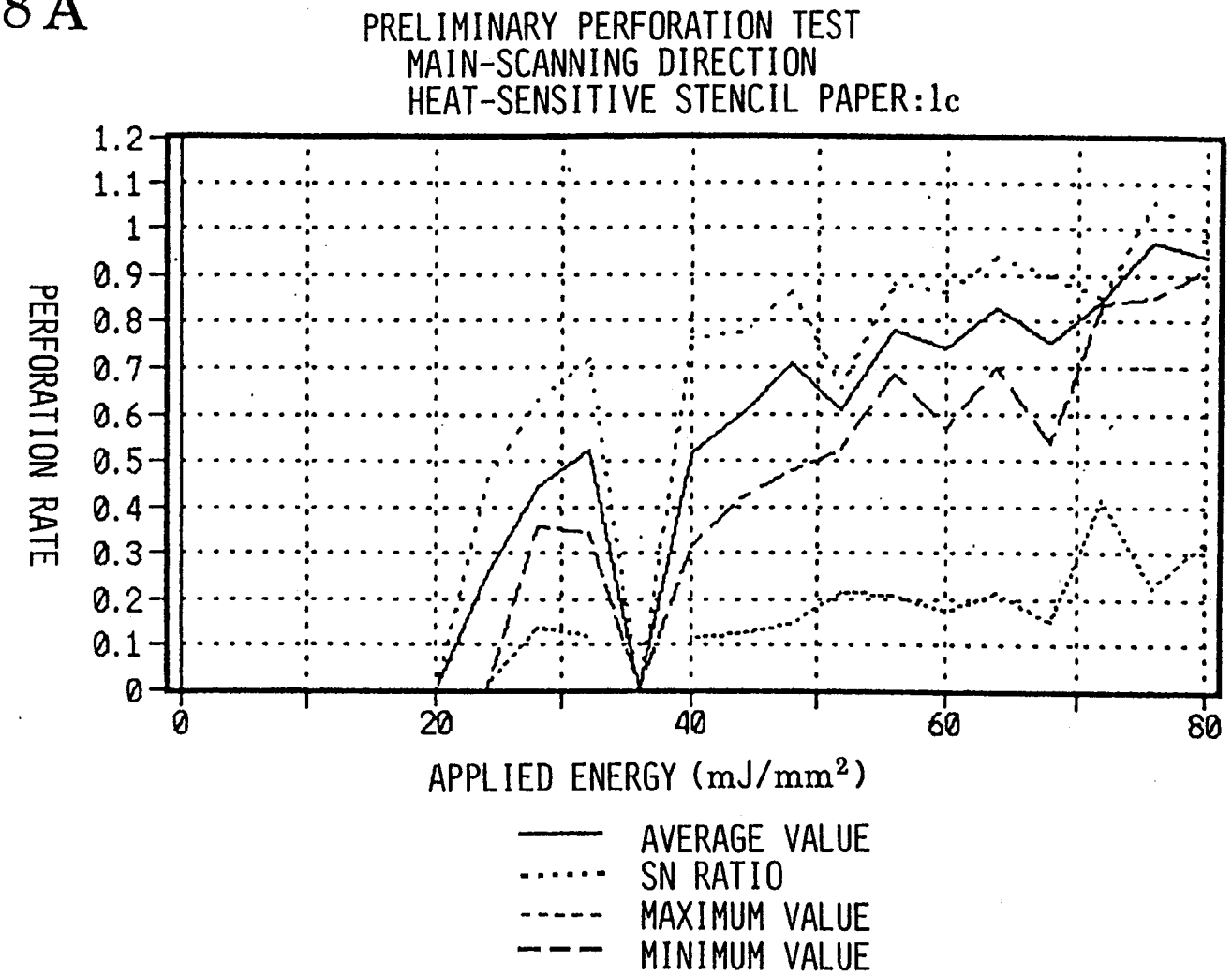
Figure 8B:
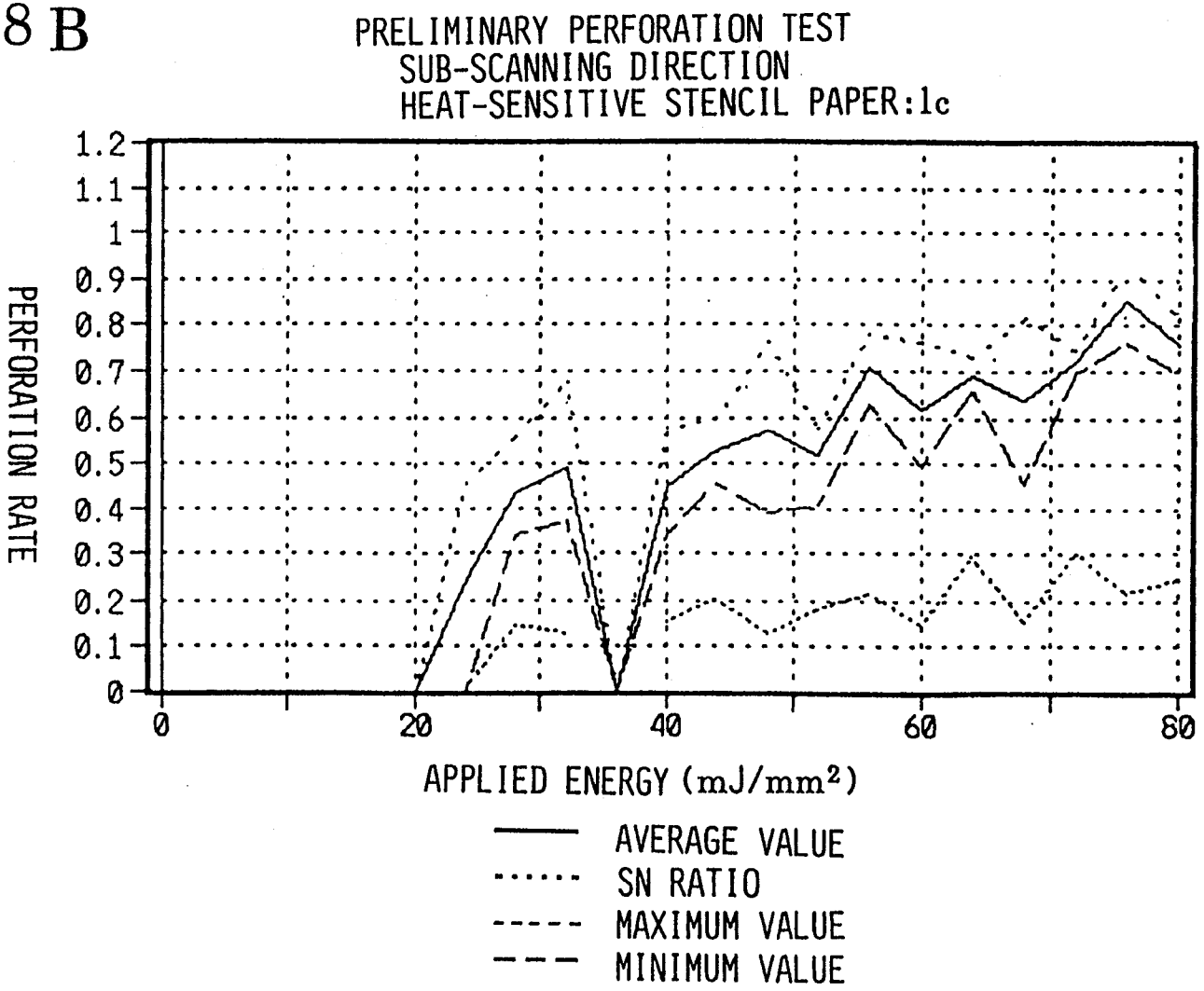

As is apparent from FIGS. 8A and 8B, the perforation rates in both the main-scanning direction and the sub-scanning direction of the stencil paper 1c are low with more variation and does not reach a stable region. The perforation rate in the sub-scanning direction is lower than that in the main-scanning direction as mentioned above.

Figure 9A:
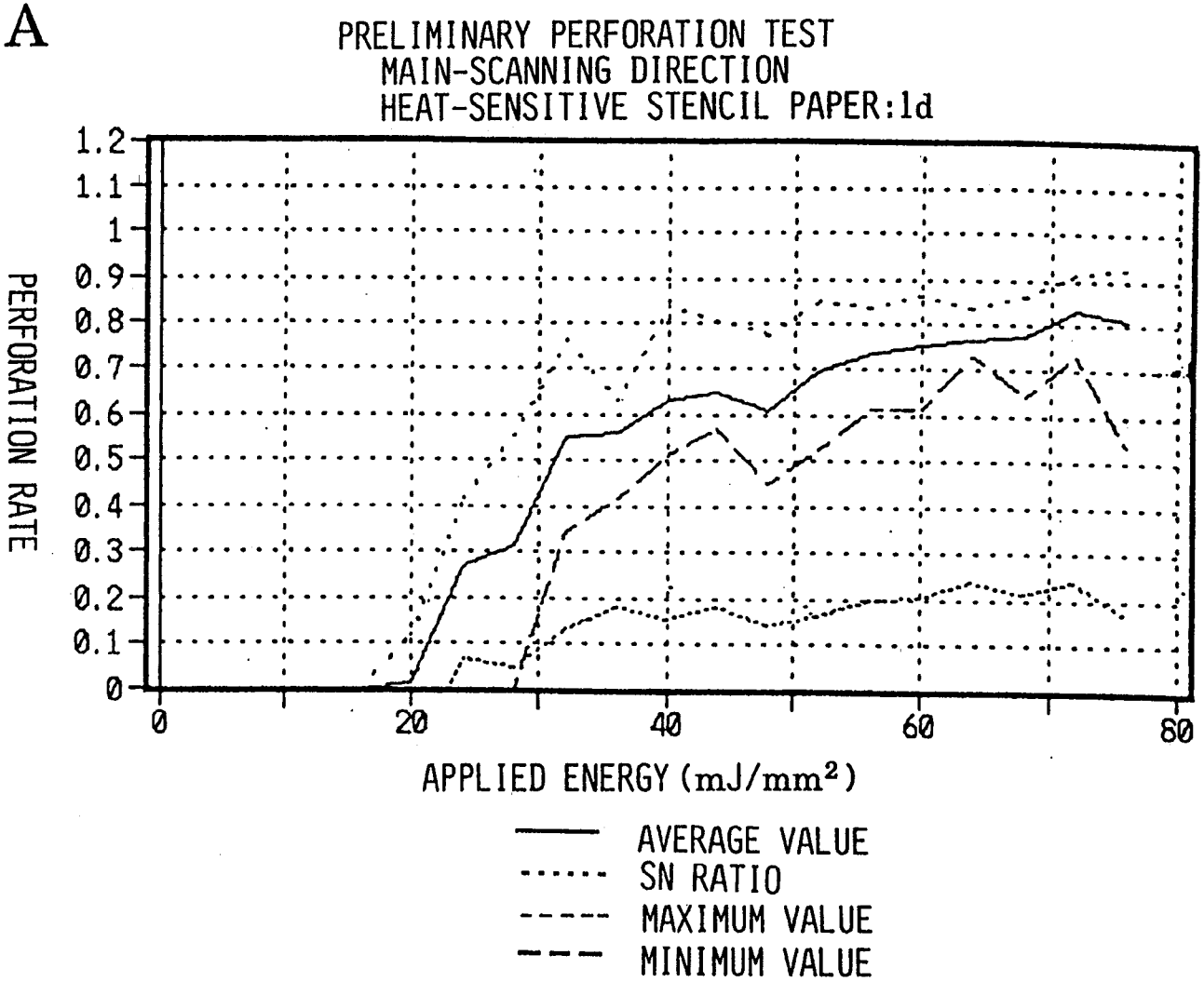
Figure 9B:
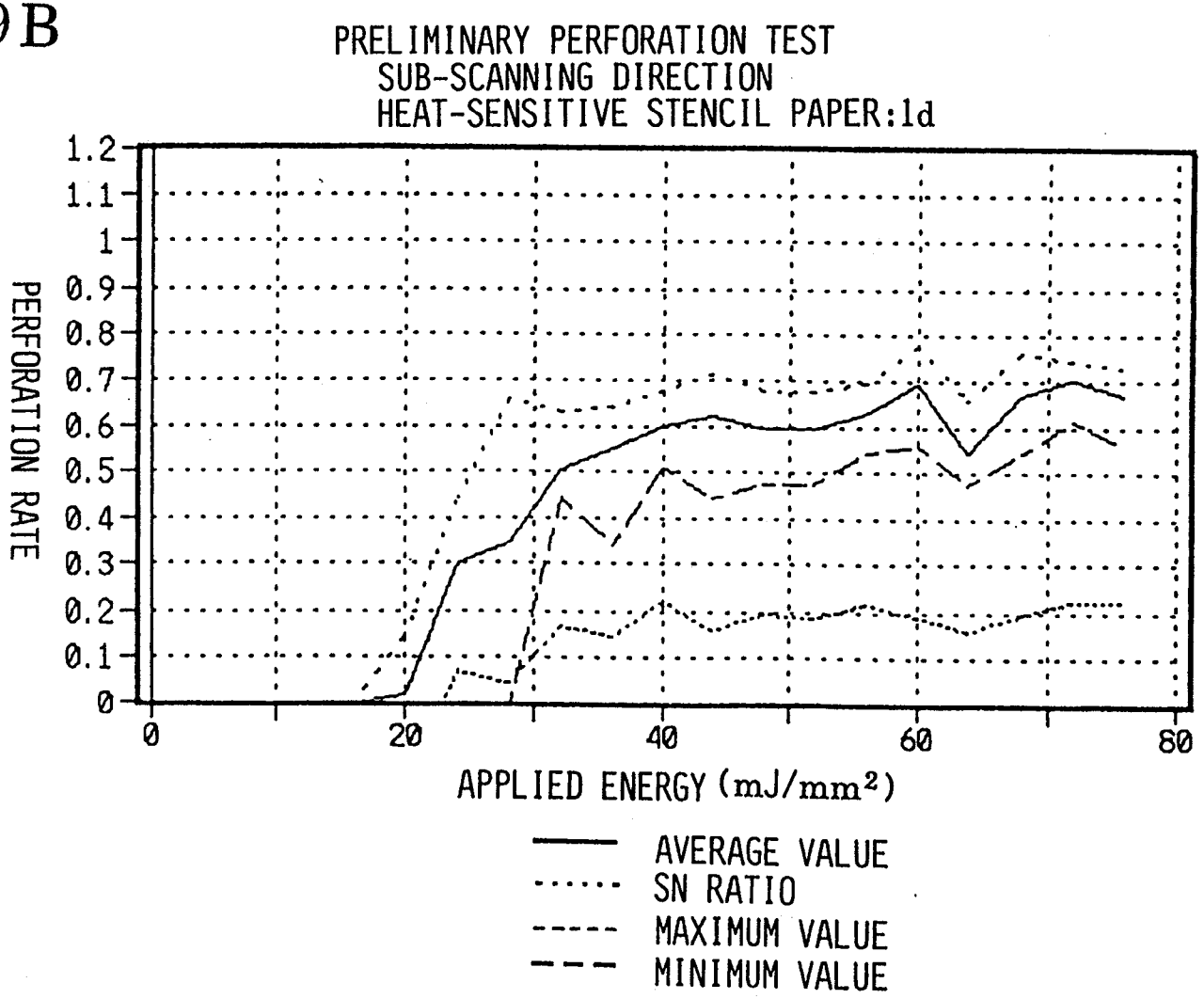

As is apparent from FIGS. 9A and 9B, the perforation rates in both the main-scanning direction and the sub-scanning direction of the stencil paper 1d are low, but enter a stable region with less variation at an applied energy of about 40 mJ/mm2. The perforation rate in the sub-scanning direction is lower than that in the main-scanning direction as mentioned above, and the gradient in the sub-scanning direction in the stable region is much gentler than that in the main-scanning direction.

Figure 10A:
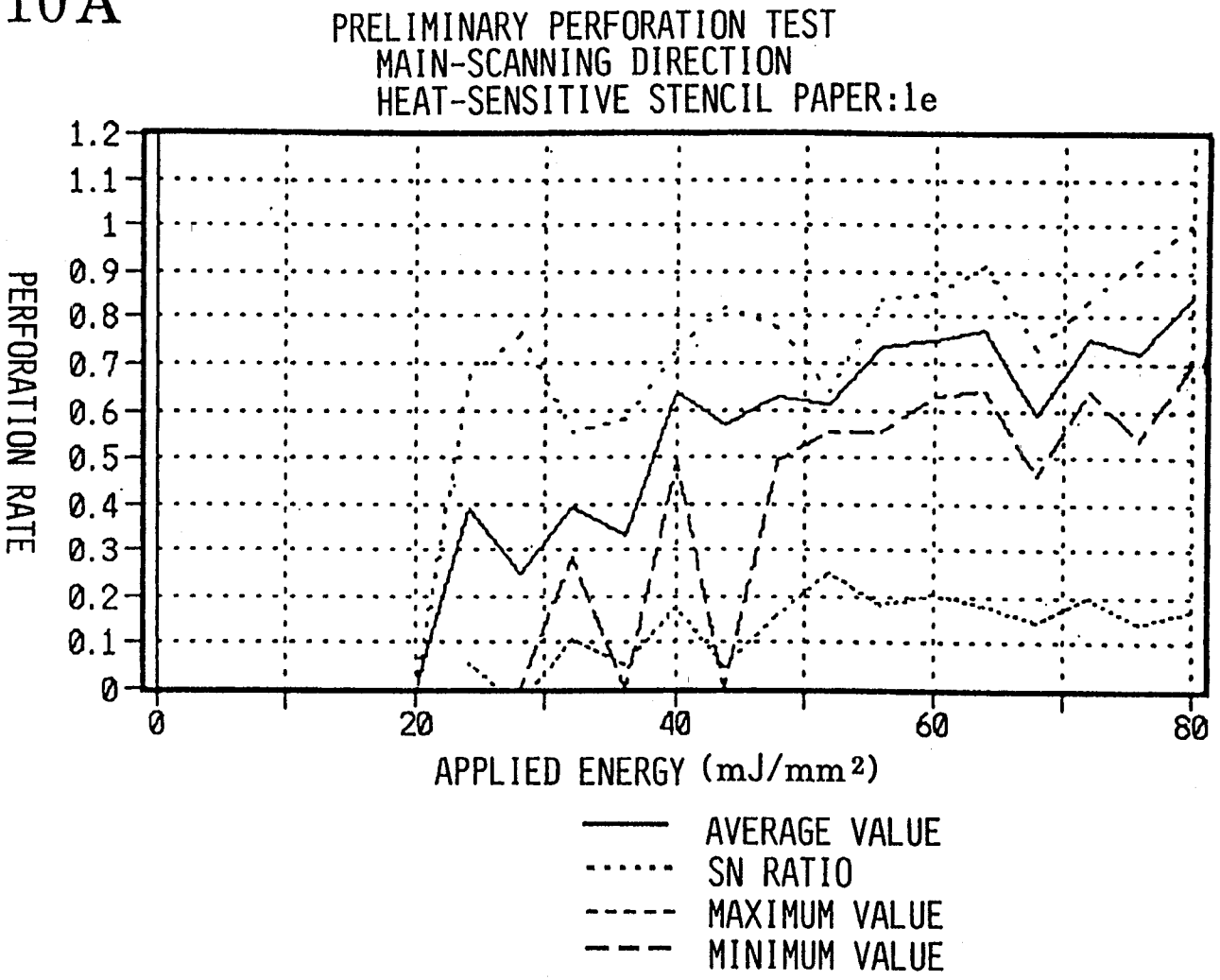
Figure 10B:
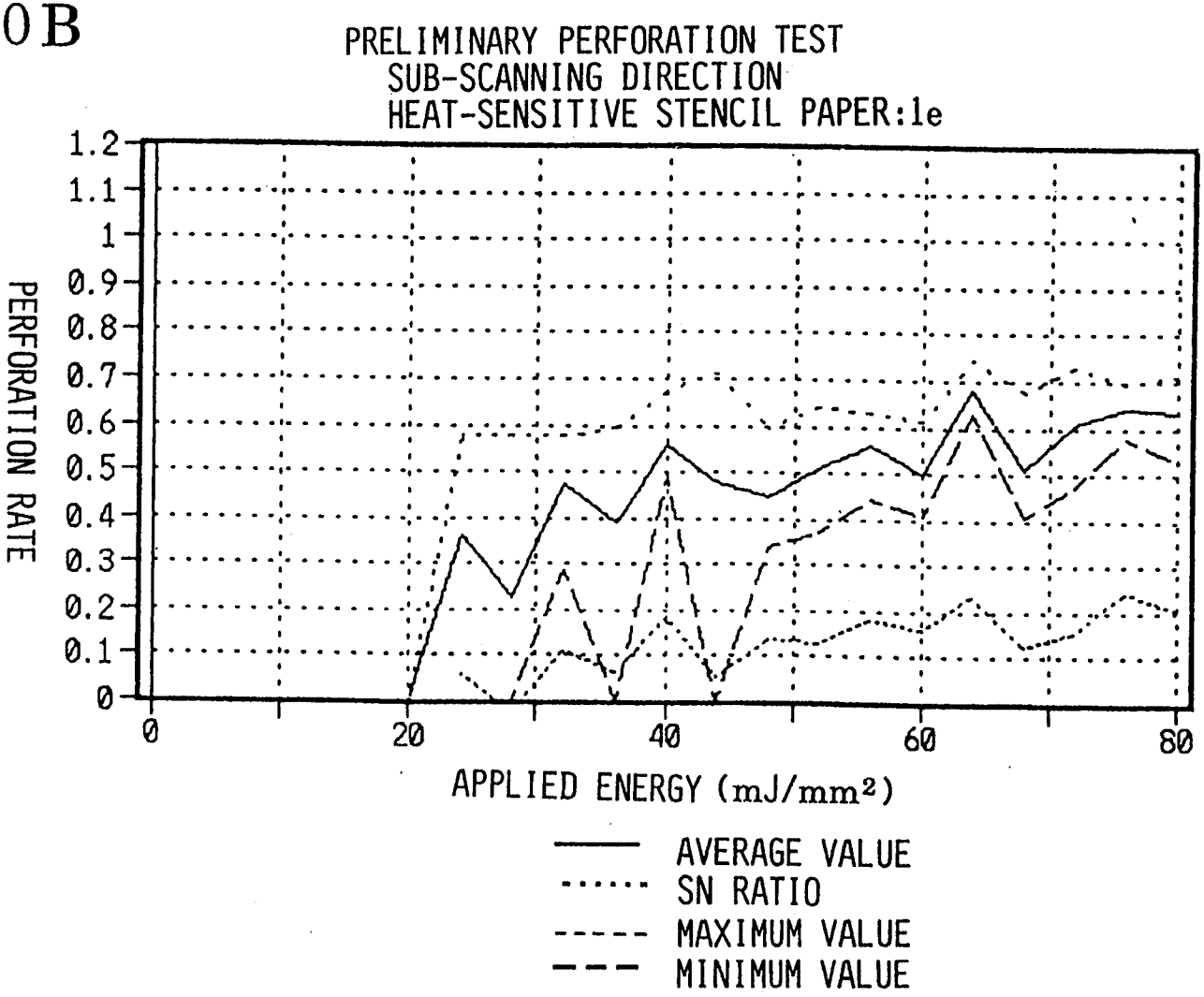

As is apparent from FIGS. 10A and 10B, the perforation rates in both the main-scanning direction and the sub-scanning direction of the stencil paper 1D are low with more variation. The perforation rates enter a stable region at an applied energy of about 40 mJ/mm2, but they are less stable in the stable region. The perforation rate in the sub-scanning direction is lower than that in the main-scanning direction as mentioned above.

Figure 11:
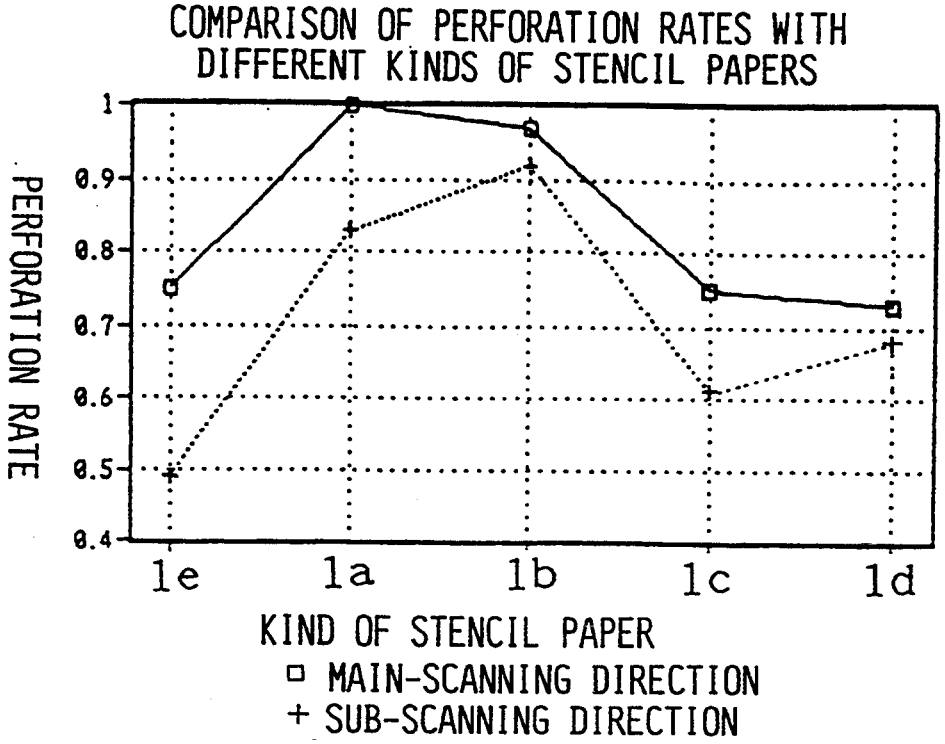
FIG. 11 is a graph showing the relationship between the kind of the stencil paper and the perforation rate.
Figure 12:
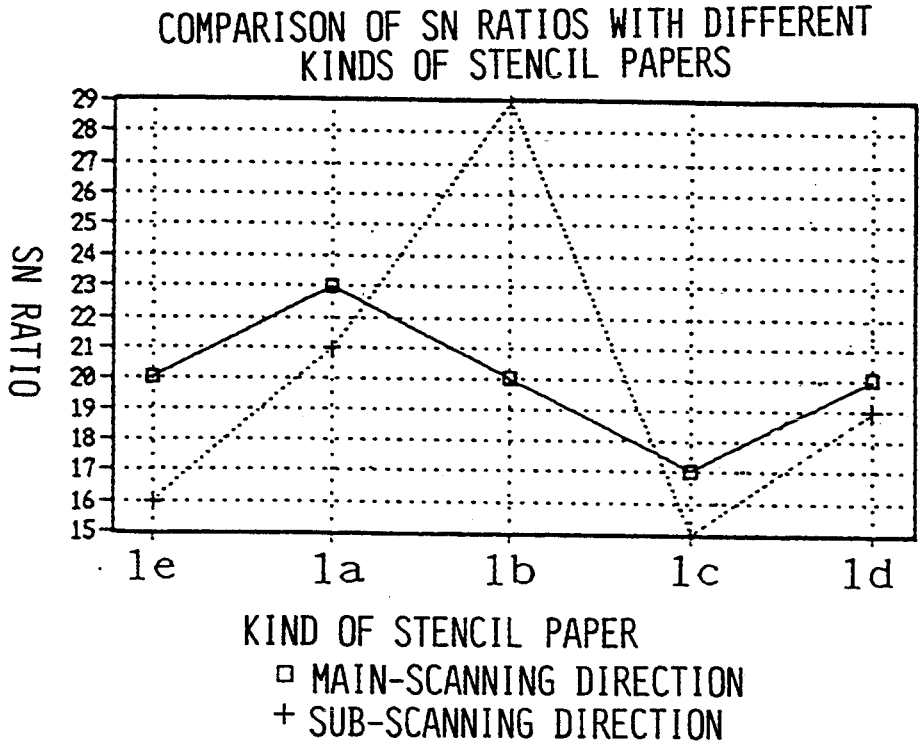
FIG. 12 is a graph showing the relationship between the kind of the stencil paper and an SN ratio.

The relationship between the kind of the stencil paper 1 and the perforation rate at the applied energy of 60 mJ/mm2 in the stable region is shown in FIG. 11, and the relationship between the kind of the stencil paper 1 and the SN ratio (degree of variations) at the applied energy of 60 mJ/mm2 in the stable region is shown in FIG. 12.

As is apparent from FIGS. 11 and 12, the perforation rates of both the stencil papers 1a and 1b are high, that is, the sensitivities are good. Further, the SN ratios of both the stencil papers 1a and 1b are high, that is, the variations are less. On the other hand, the perforation rate of the stencil paper 1d is low, but the SN ratio is relatively high so that the variations are less.

Figure 13:
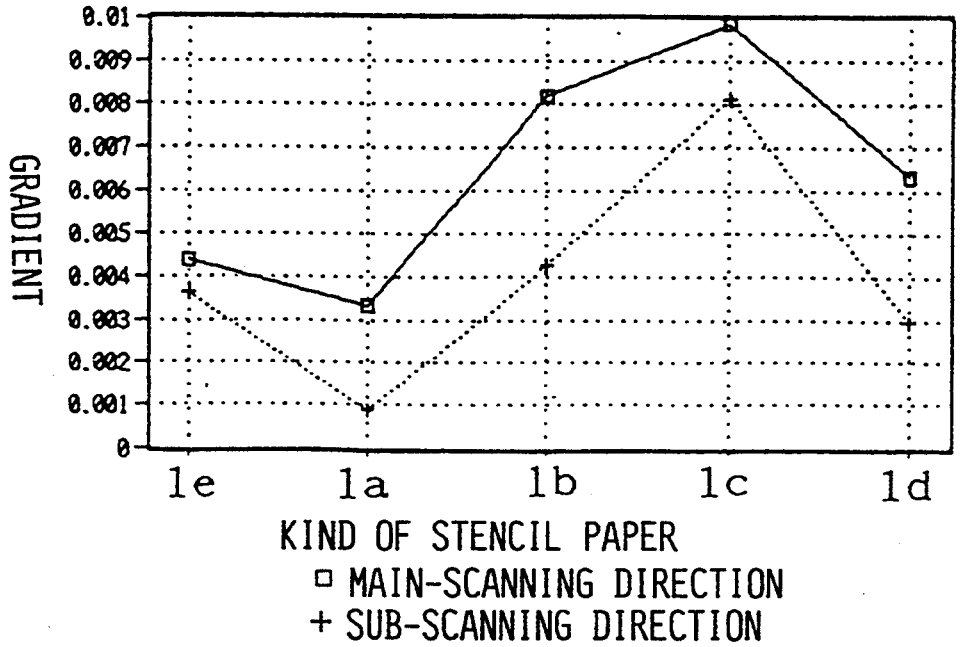
FIG. 13 is a graph showing the relationship between the kind of the stencil paper and a gradient of the perforation rate in a stable region.
Figure 14:
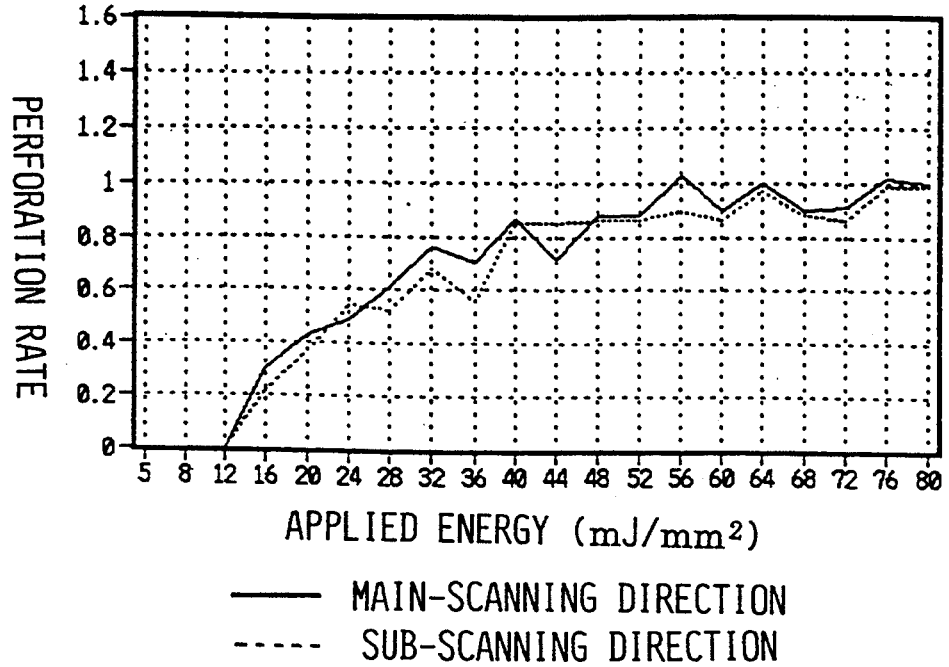
FIGS. 14, 15, 16 and 17 are graphs showing the relationship between an applied energy and a perforation rate in four kinds of thermal heads according to the invention.
Figure 15:
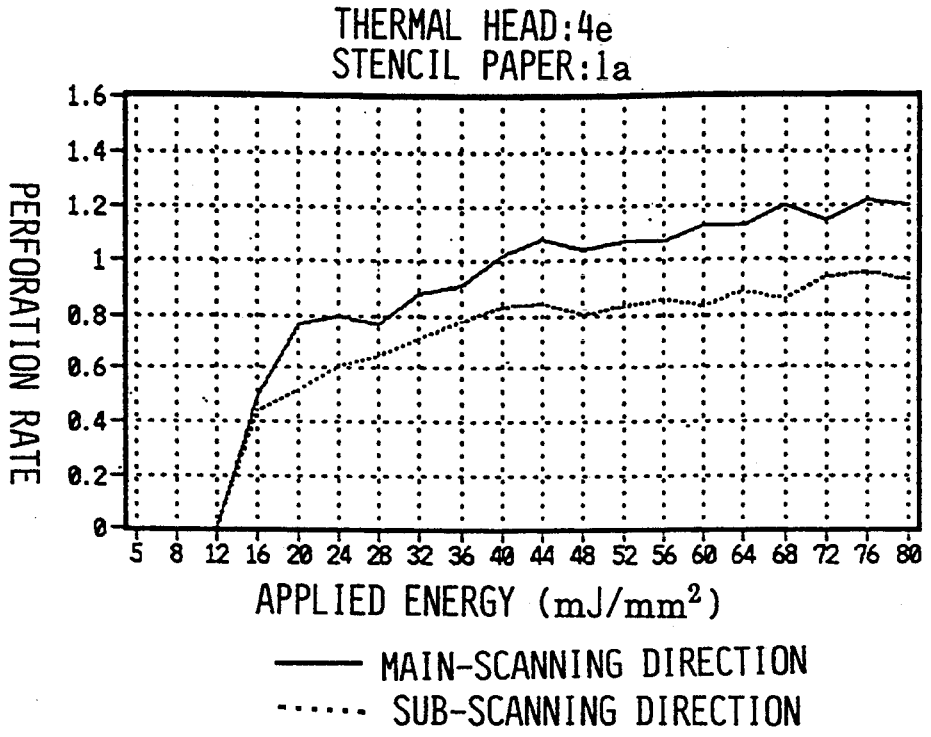
Figure 16:
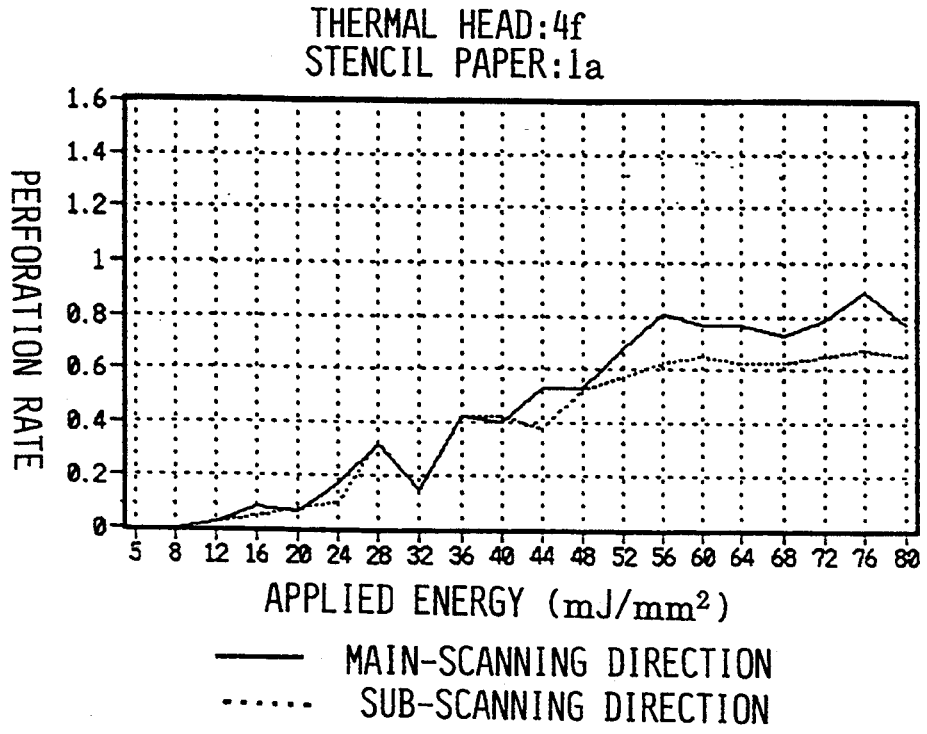
Figure 17:
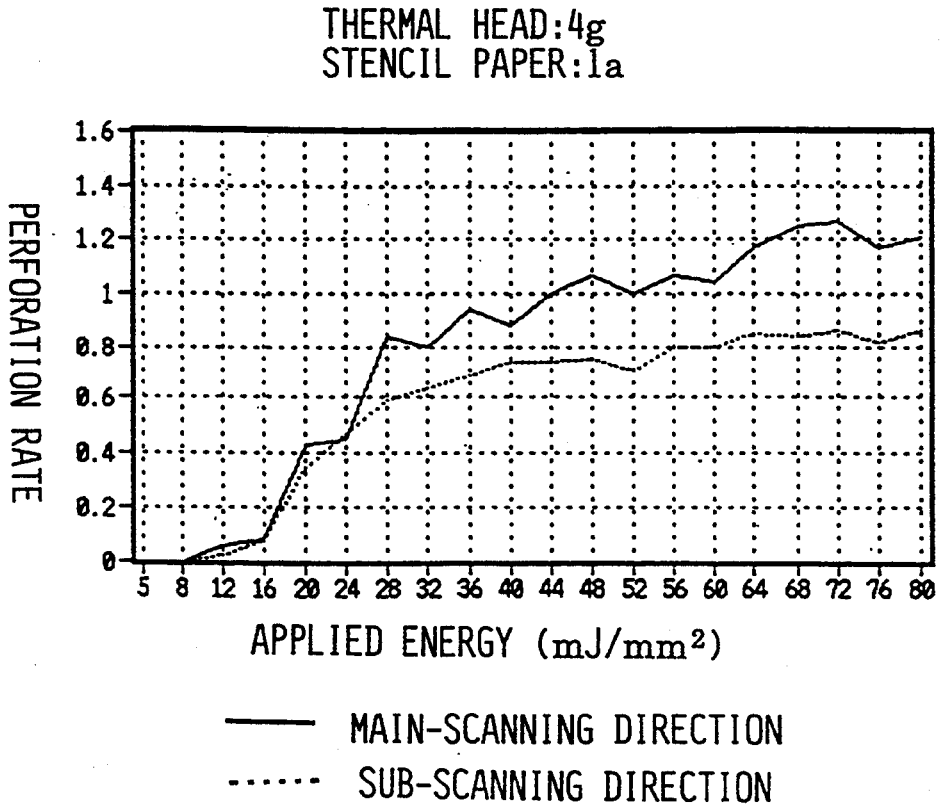

The relationship between the kind of the stencil paper 1 and the gradient of the perforation rate in the stable region is shown in FIG. 13.

As is apparent from FIG. 13, the gradients of the perforation rates of the stencil papers 1a and 1d are small. That is, a fluctuation in the perforation rate with respect to a change in the applied energy is small.

It is concluded from the above results that the stencil paper 1a employing PET fiber as the material for the porous carrier is a preferable stencil paper with the highest perforation rate, lesser variations in the perforation rate, and little influenced by an energy change in the stable region.

Thus, the applied energy and the stencil paper are to be preferably set so as to reduce the gradient of the perforation rate in the stable region, reduce the variations in the perforation rate, and satisfy the perforation rate in the main-direction A/a=1.

Next, the correlation between the perforation rate and the applied energy in relation to a difference in size of each heat generating element of the thermal head 4 will be examined.

The following thin-film type thermal heads, designated as 4d to 4g and each having a resolution of 300 DPI, were mounted to the thermal stenciling device, and stenciling was performed to the following heat-sensitive stencil paper designated as 1a.

Thermal head 4d:
Dot size (μm): 67 (main-scanning direction)×59 (sub-scanning direction);
Dot area (μm²): 3953;
Resistance (Ω): 526;
Applied power (w/mm²): 40 (0.158 w/dot); and Applied energy (mJ/mm²): 5 to 80.
Thermal head 4e:
Dot size (μm): 65 (main-scanning direction)×77 (sub-scanning direction);
Dot area (μm²): 5005;
Resistance (Ω): 670;
Applied power (w/mm²): 40 (0.200 w/dot); and
Applied energy (mJ/mm²): 5 to 80.
Thermal head 4f:
Dot size (μm): 47 (main-scanning direction)×40 (sub-scanning direction);
Dot area (μm²): 1880;
Resistance (Ω): 482;
Applied power (w/mm²): 40 (0.075 w/dot); and
Applied energy (mJ/mm²): 5 to 80.
Thermal head 4g:
Dot size (μm): 49 (main-scanning direction)×80 (sub-scanning direction);
Dot area (μm²): 3920;
Resistance (Ω): 1000;
Applied power (w/mm²): 40 (0.157 w/dot); and
Applied energy (mJ/mm²): 5 to 80.
Stencil paper 1a:
Thermoplastic resin film:
Material: polyethylene terephthalate (PET),
Thickness (μm): 1.8,
Melting point (°C.): 214; and
Porous carrier:
Material: PET fiber,
Thickness (μm): 40.

Figure 18:
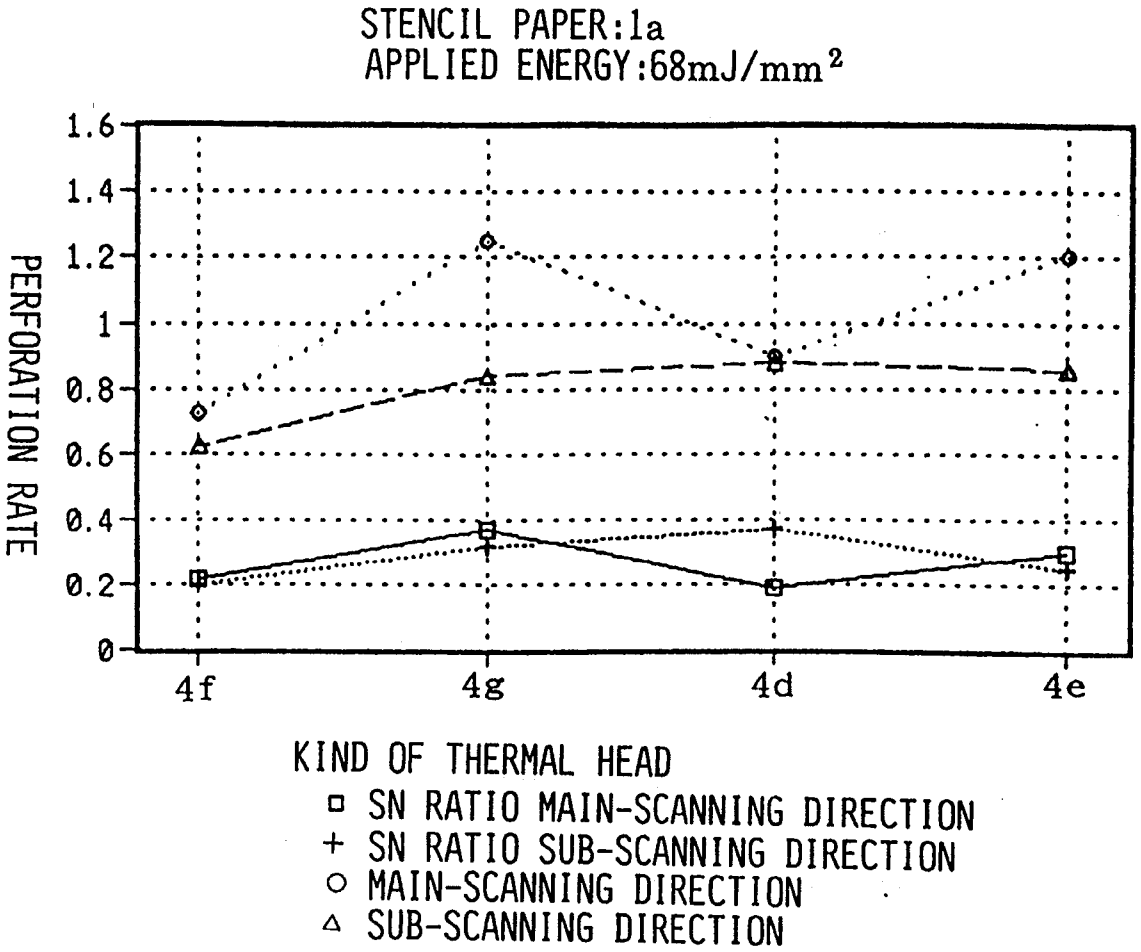
FIG. 18 is a graph showing the relationship between the kind of the thermal head and the perforation rate.
Figure 19:
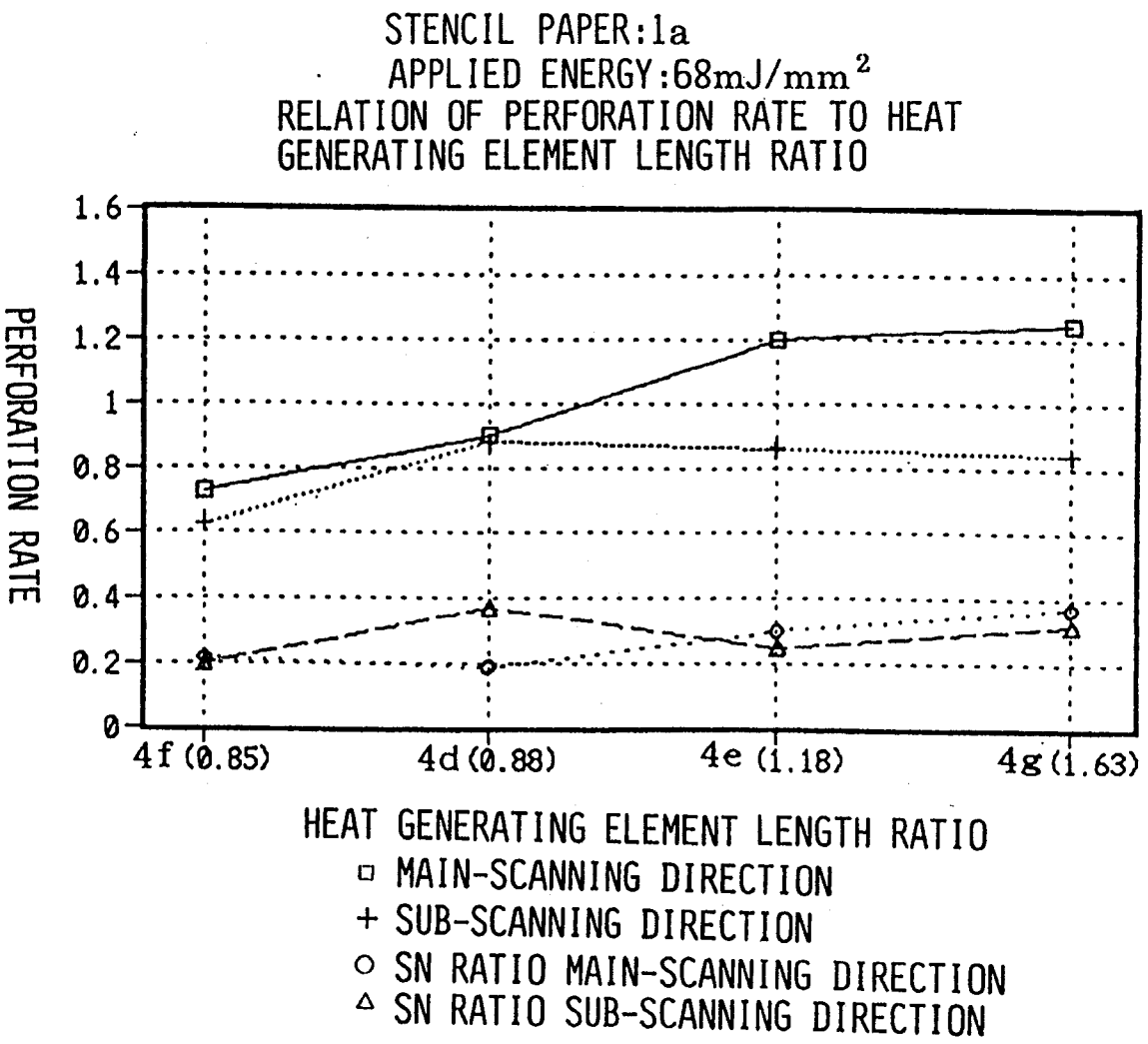
FIG. 19 is a graph showing the relationship between the ratio of a length of each heat generating element in the sub-scanning direction to that in the main-scanning direction and the perforation rate.

The relationship between the applied energy and the perforation rate in the thermal heads 4d to 4g is shown in FIGS. 14 to 17. Further, the relationship between the kind of thermal head 4 and the perforation rate at the applied energy of 68 mJ/mm2 in the stable region is shown in FIG. 18, so as to clearly present the differences in the perforation rates between the thermal heads 4d to 4g. Further, the relationship between the ratio b/a and the perforation rate at the applied energy of 68 mJ/mm2 in the stable region is shown in FIG. 19. In FIG. 19, the ratio b/a is defined as the ratio of the length b of each heat generating element 50 of each thermal head in the sub-scanning direction to the length a of each heat generating element 50 of each thermal head in the main-scanning direction, which ratio will be hereinafter referred to as a vertical to horizontal ratio. In the abscissa in FIG. 19, the thermal heads 4d to 4g are rearranged in the order of the magnitude of the vertical to horizontal ratio b/a.

As is apparent from FIG. 19, the perforation rate in the main-scanning direction increases with an increase in the vertical to horizontal ratio, but the perforation rate in the sub-scanning direction hardly changes with the increase in the vertical to horizontal ratio.

As is generally known, the perforation rate increases with an increase in the applied energy, and this fact depends on the surface temperature distribution of each heat generating element 50 as mentioned above. While the perforation rate in the main-scanning direction increases with the increase in the vertical to horizontal ratio as shown in FIG. 19, the relationship between the applied energy and the vertical to horizontal ratio will now be described.

The resistance R of each heat generating element 50, the applied power W and the applied energy E to each heat generating element 50 are introduced by the following formulas.

$$R = r \times b/a \quad (5)$$

R: resistance of each heat generating element 50 (Ω); and
r: specific resistance of each heat generating element 50 (Ω).

$$W = V^2/R/S, \text{ where:} \quad (6)$$

W: applied power (w/mm²);
V: applied voltage (V); and
S: area of each heat generating element 50 (=a×b) (mm²).

$$E = W \times t, \text{ where:} \quad (7)$$

E: applied energy (mJ/mm²); and
t: applied time (msec).

From the above three formulas, the following is introduced:

$$W = V^2/(r \times b/a)/S;$$

$$E = (V^2/(r \times b/a)/S) \times t; \text{ and}$$

$$V^2 = E \times r/t \times b/a \times S \ (E,\ r,\ t\text{: constant}).$$

It is appreciated from the above formulas that $V^2$ is proportional to b/a×S. That is, the square of the applied voltage V is proportional to the product of the vertical to horizontal ratio b/a and the area S of each heat generating element 50. Further, the square of the applied voltage V is proportional to the applied energy E and the area S of each heat generating element 50 is equal to a×b. Accordingly, the applied energy E is proportional to the square of the length b of each heat generating element 50 in the sub-scanning direction.

Figure 20:
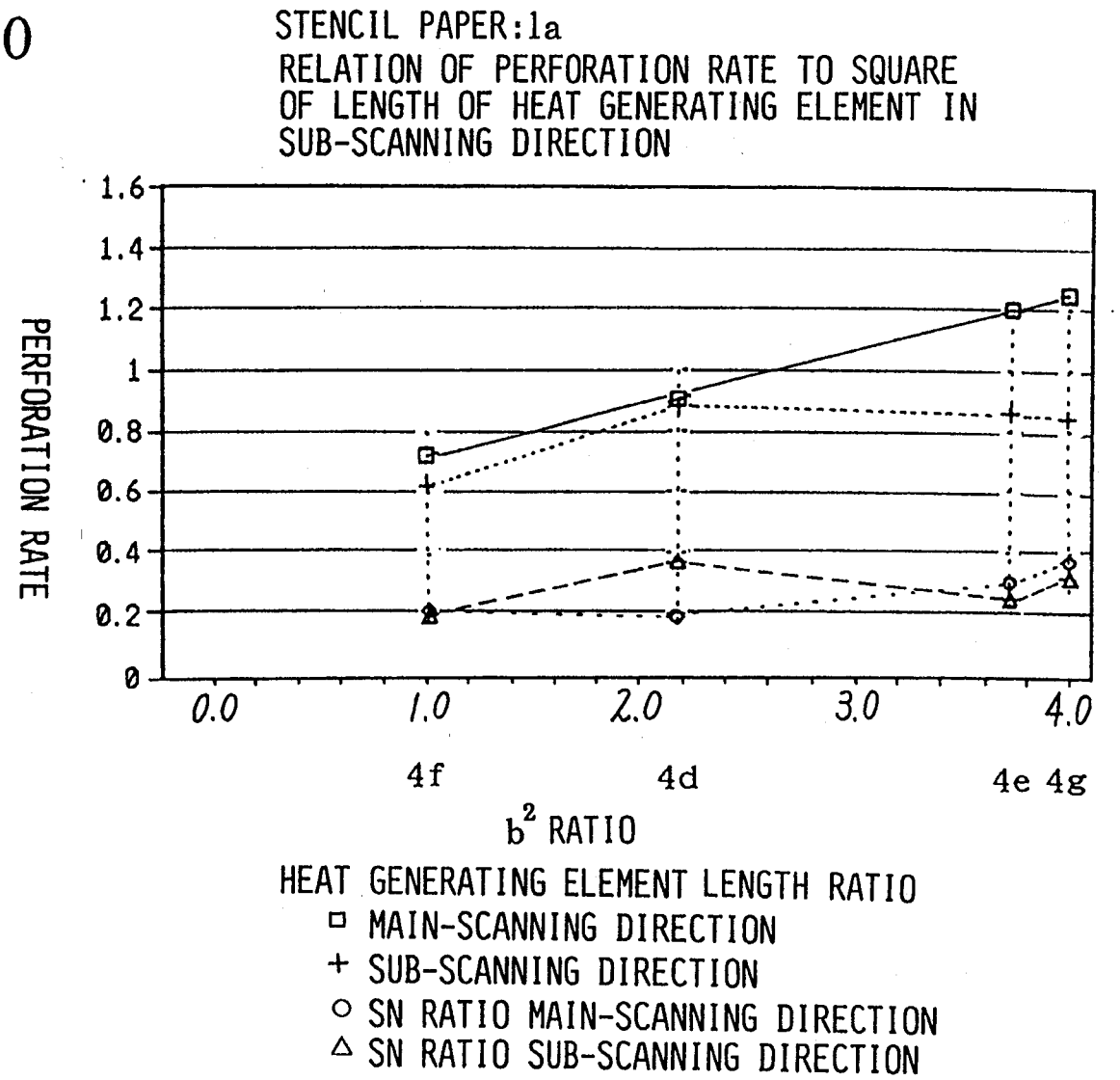
FIG. 20 is a graph showing the relationship between the square of the length of each heat generating element in the sub-scanning direction and the perforation rate.
Figure 21A:
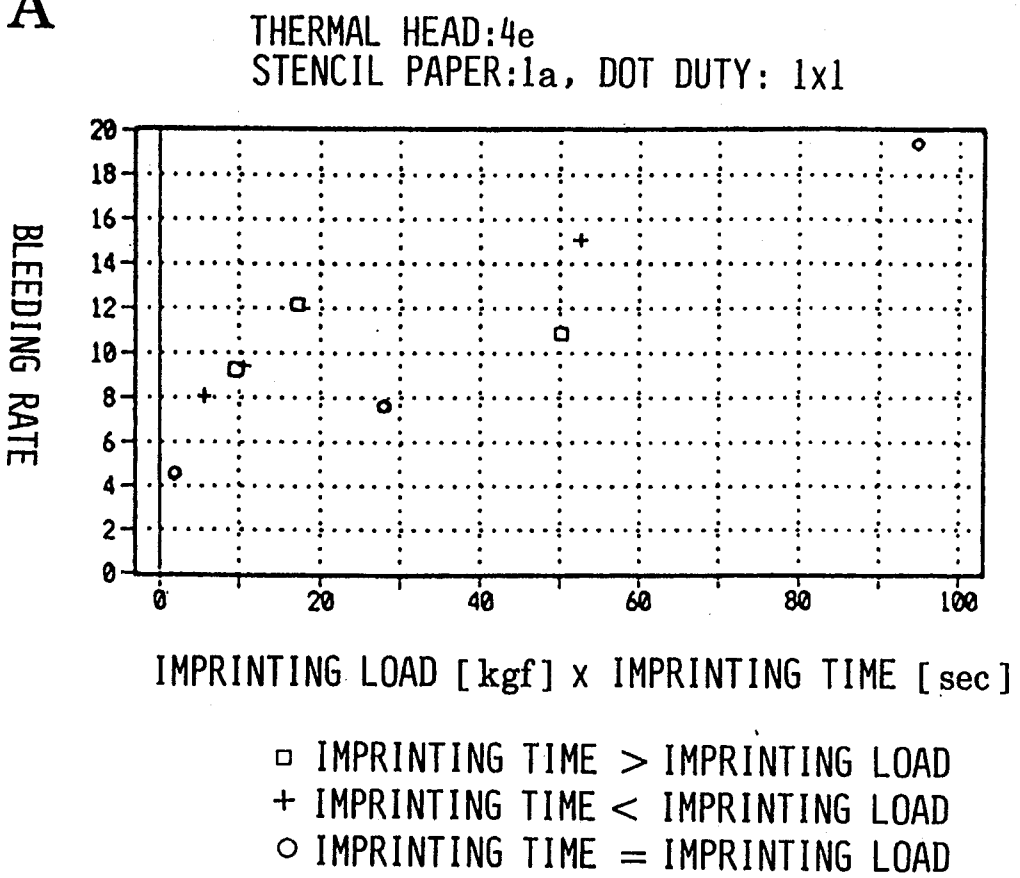
FIGS. 21A, 21B, 21C, 22A, 22B, 22C, 23A, 23B, 23C, 24A, 24B and 24C are graphs showing the relationship between a bleeding rate and an imprinting energy in four combinations of two kinds of stencil papers and two kinds of thermal heads in relation to a difference in dot duty according to the invention.
Figure 21B:
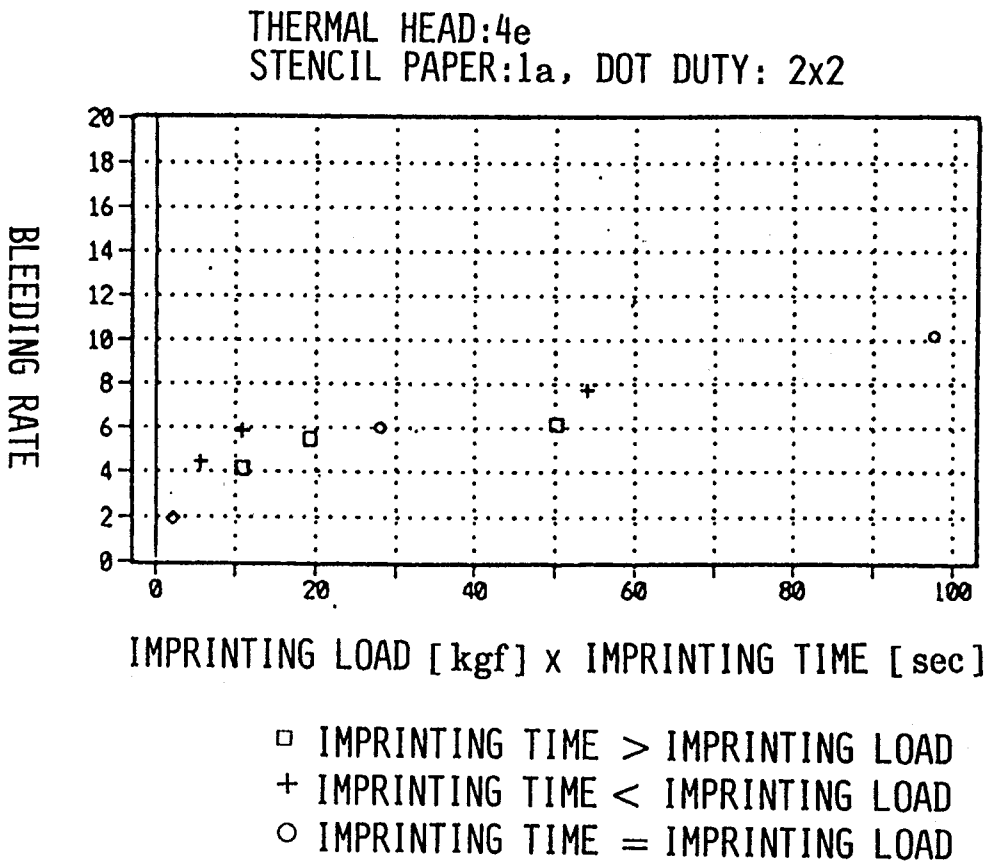
Figure 21C:
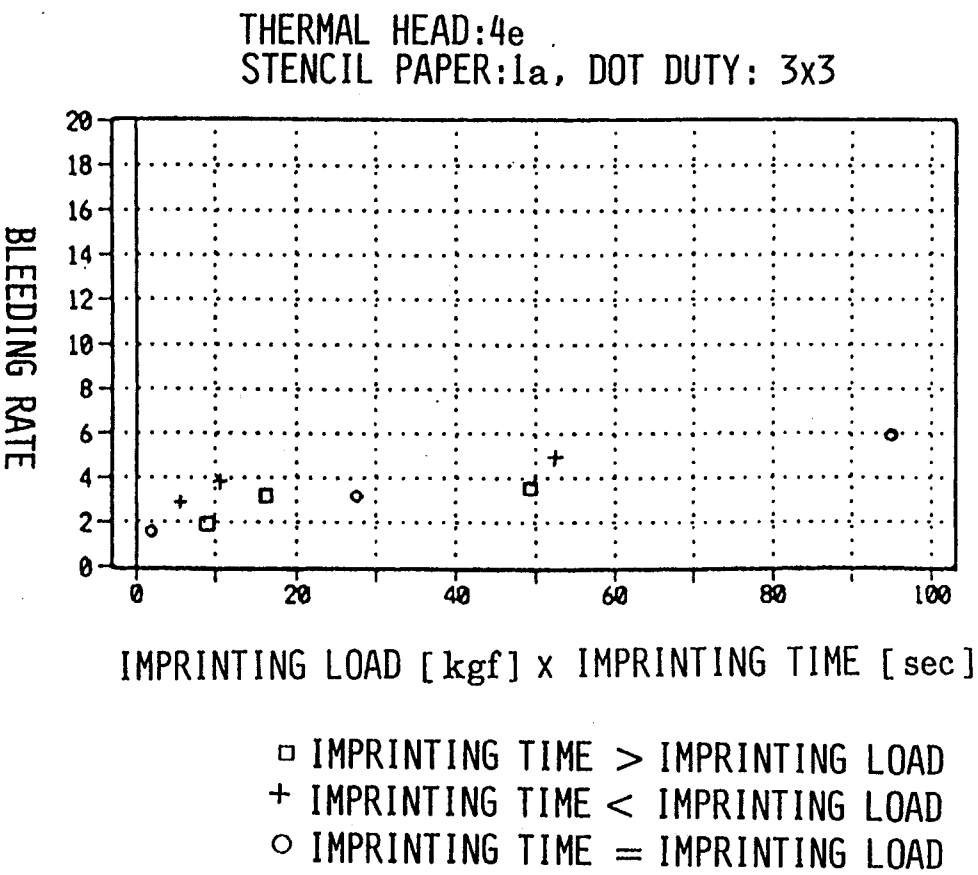
Figure 22A:
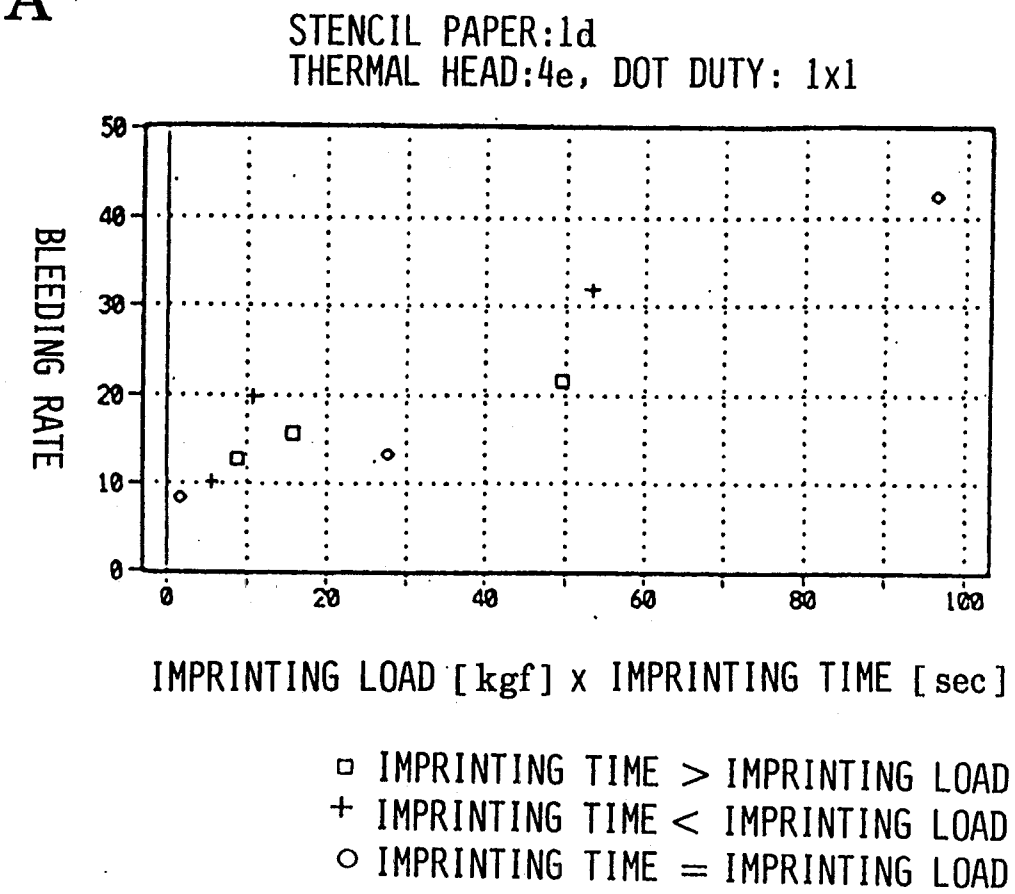
Figure 22B:
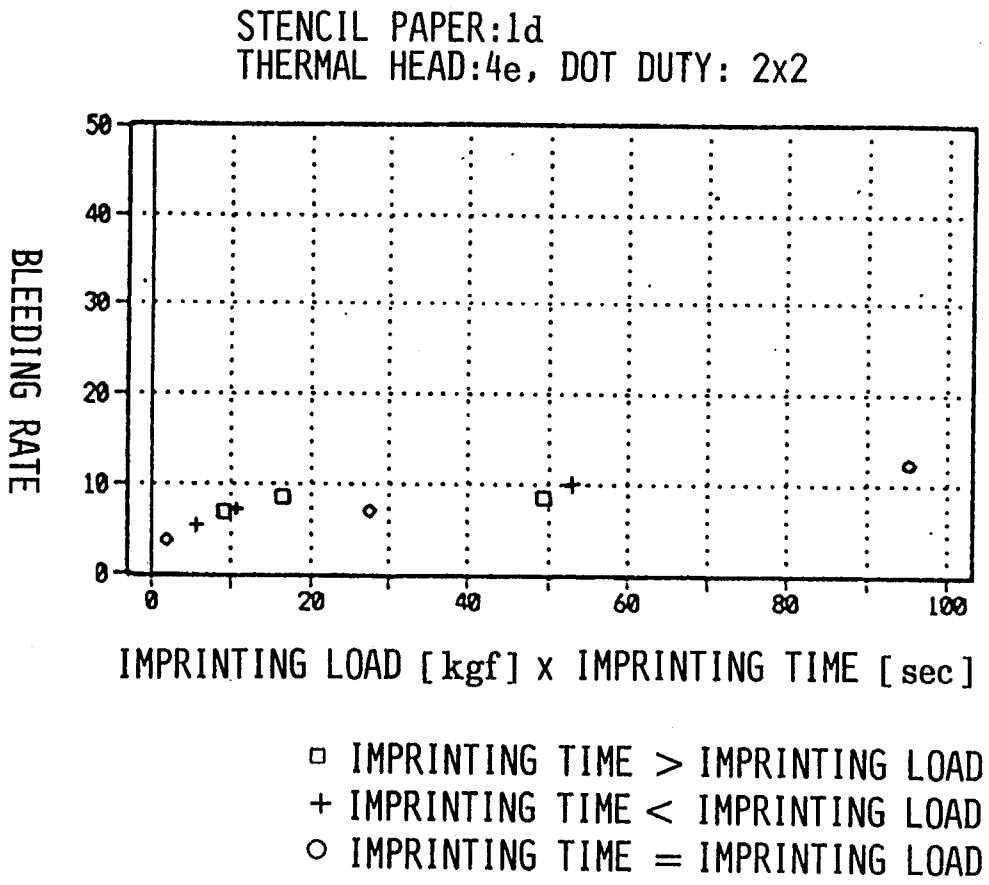
Figure 22C:
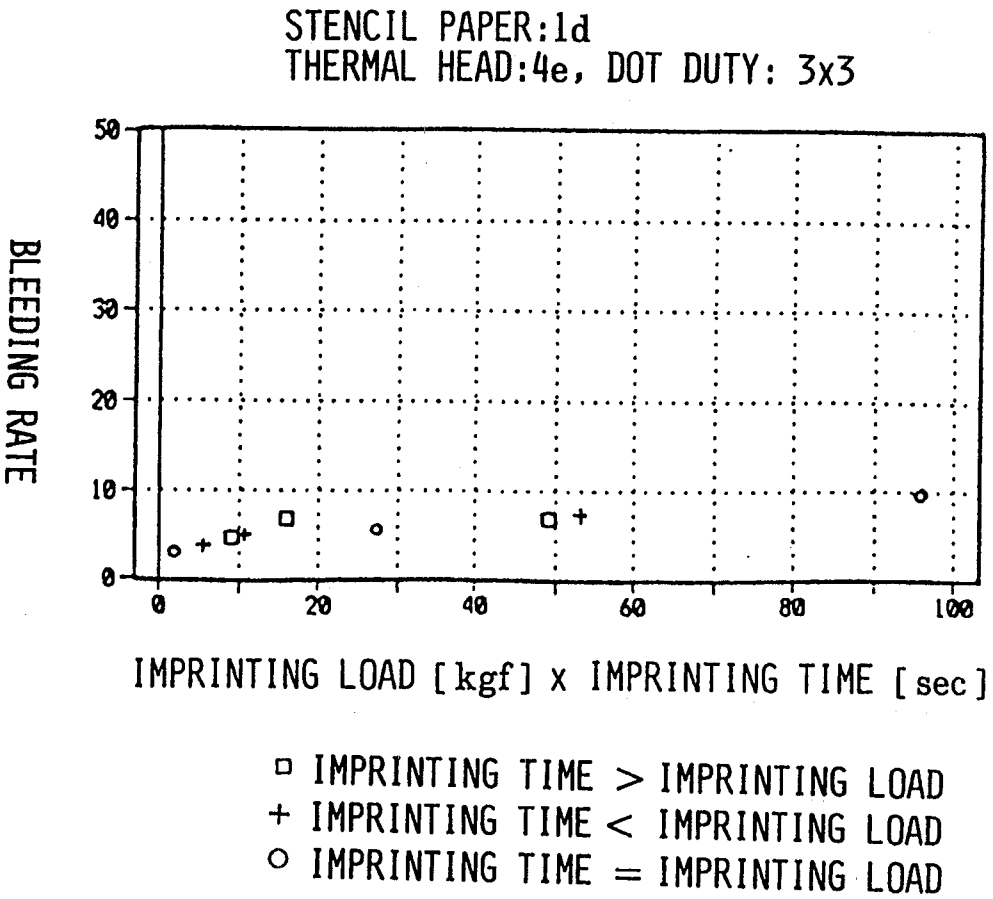
Figure 23A:
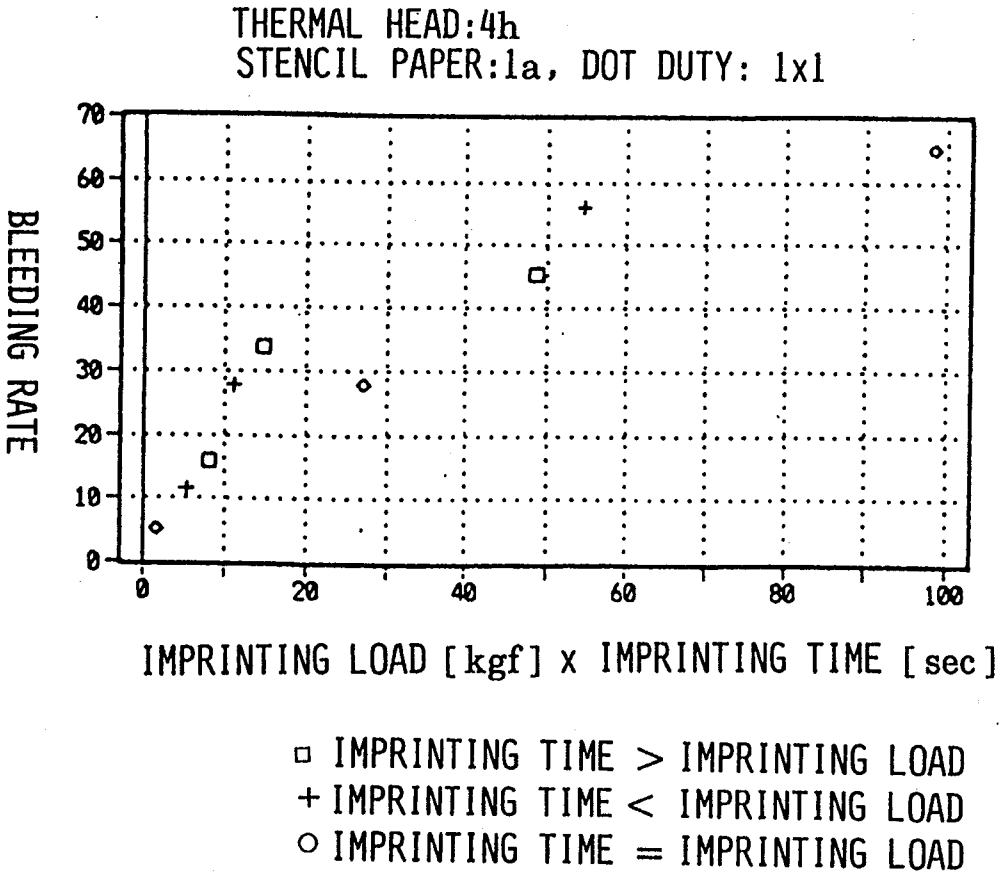
Figure 23B:
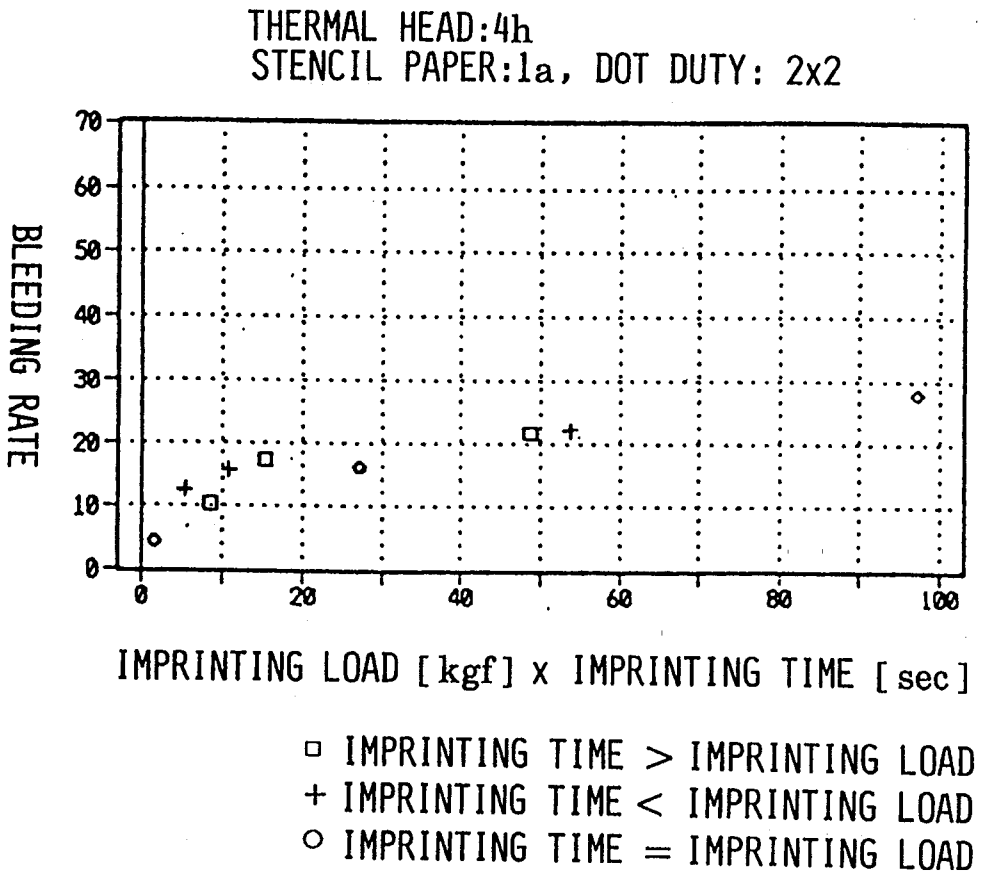
Figure 23C:
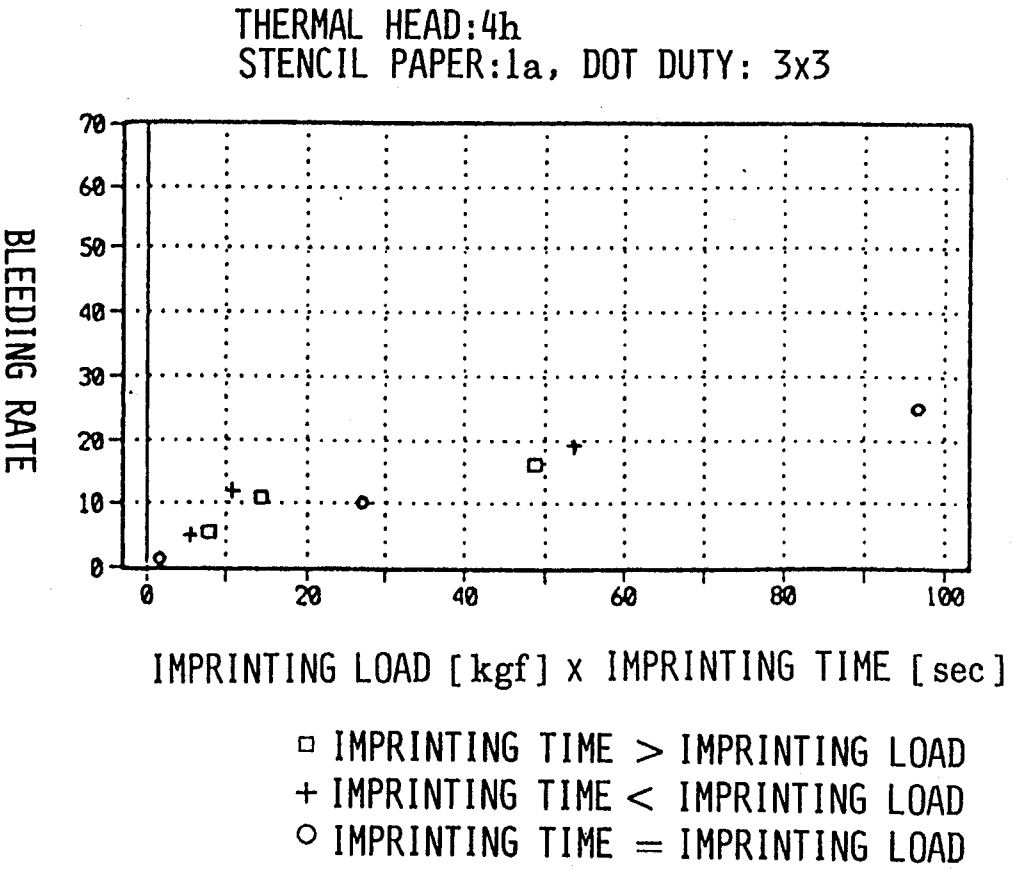
Figure 24A:
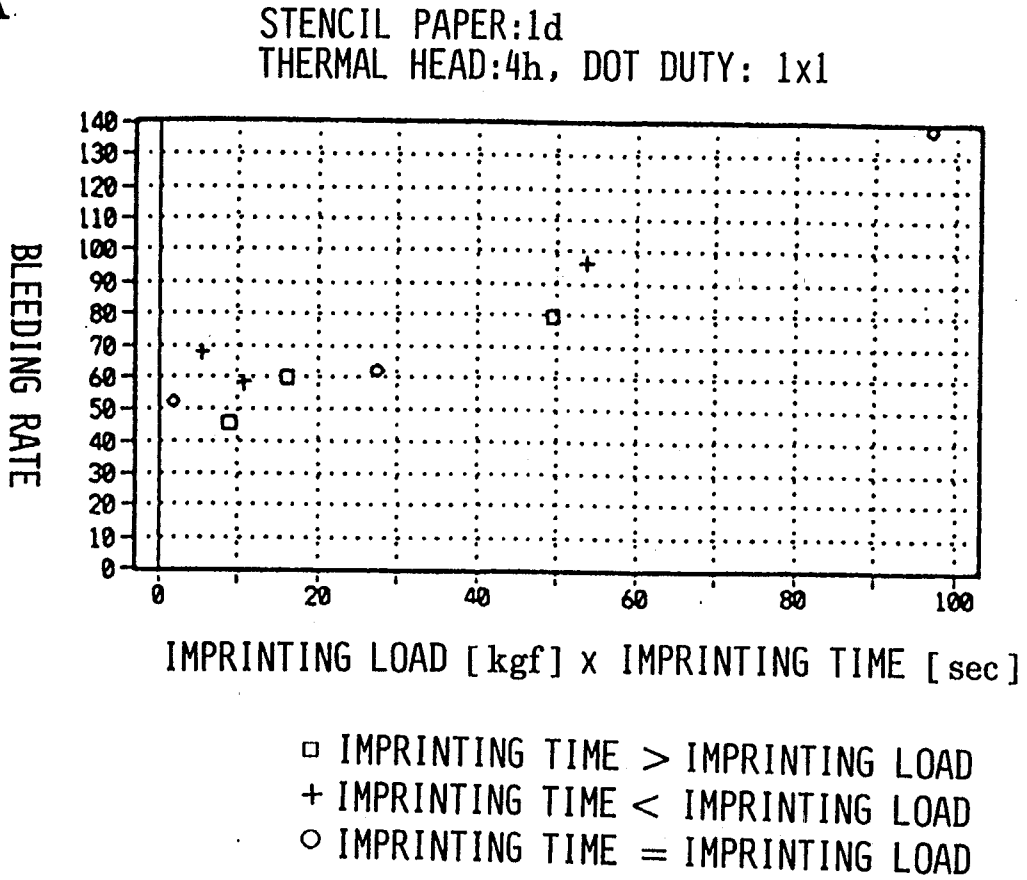
Figure 24B:
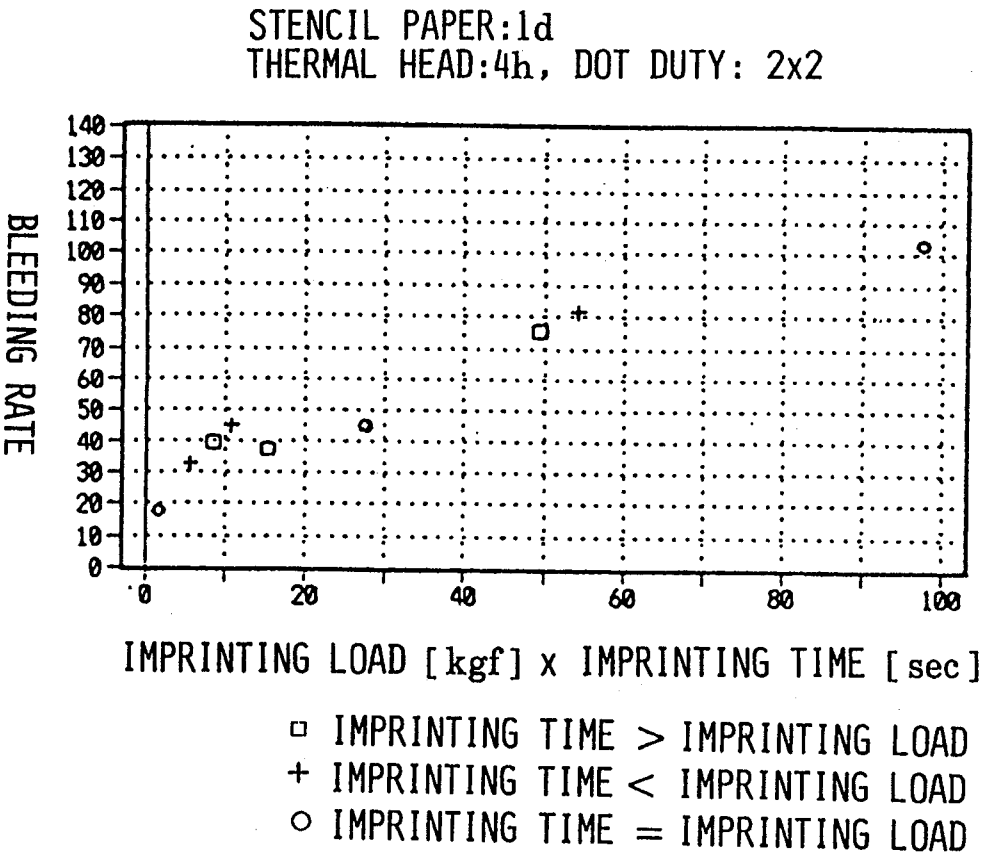
Figure 24C:
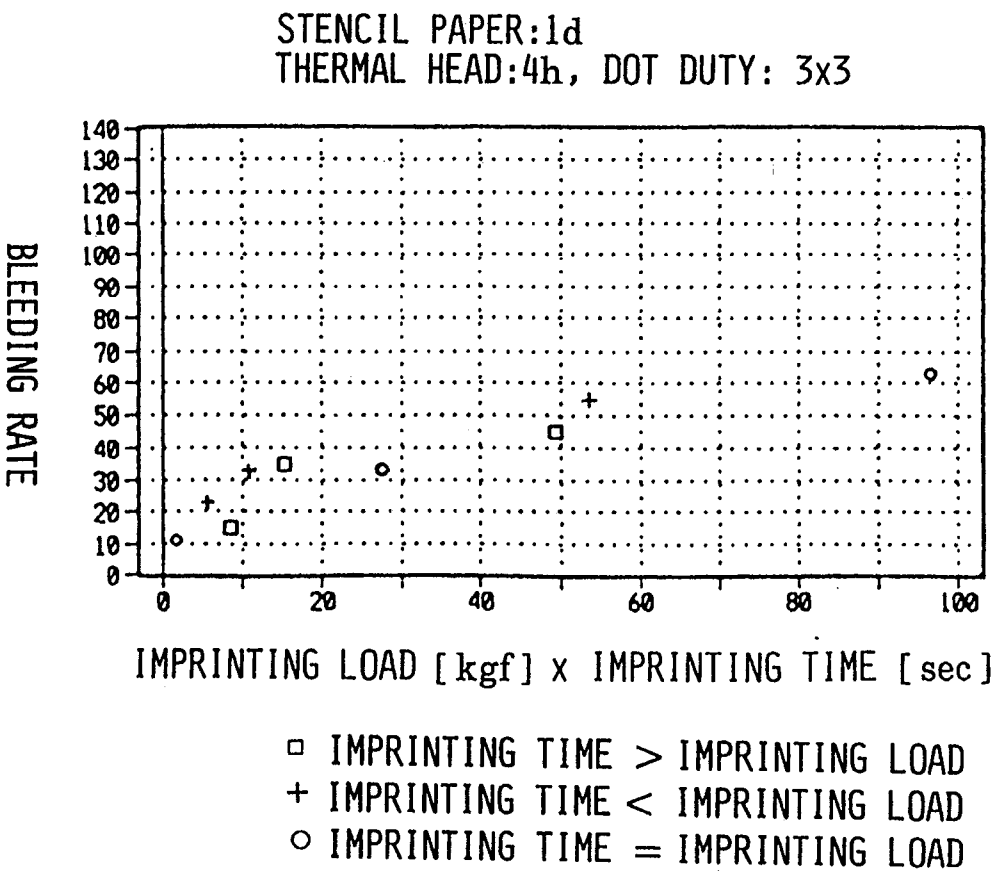

The relationship between the square of the length b in the sub-scanning direction and the perforation rate, as transformed from FIG. 18, is shown in FIG. 20, wherein the thermal heads 4d to 4g are rearranged in the order of the magnitude of the square of the length b. In FIG. 20, the abscissa represents the ratio of the square of the length b of the thermal heads 4d to 4g to the square of the length b of the thermal head 4f for the purpose of easy understanding of the relationship. As is apparent from FIG. 20, the perforation rate in the main-scanning direction of each thermal head is proportional to the square of the length b in the sub-scanning direction. This result agrees with the generally known fact that the perforation rate increases with an increase in the applied energy, thus proving the certainty of data in this preferred embodiment.

Consequently, it is preferable that the applied energy E and the length b in the sub-scanning direction are to be set so that the perforation rate $\beta$ in the main-scanning direction falls in the range of 0.8 to 1.2.

As is apparent from the above description, the perforation rate $\beta$ in the main-scanning direction is set to preferably one (1) from the viewpoint of evaluation in relation to the kind of the stencil paper, and is set to preferably 0.8 to 1.2 from the viewpoint of evaluation in relation to the kind of the thermal head. From the viewpoint of the total evaluation, the perforation rate $\beta$ in the main-scanning direction is set to preferably 0.8 to 1.2, and it is preferable to set the stencil paper 1, the applied energy E and the thermal head 4 (the length b in the sub-scanning direction) so as to satisfy the above condition, thus introducing Formula 2.

Formulas 3 and 4 are presented as follows:

$$A+C=Pa; \text{ and} \quad (3)$$

$$B+C=Pb \quad (4)$$

The process of introduction of Formulas 3 and 4 will be described.

First, the correlation of a bleeding rate to the stencil paper 1, the thermal head 4, a dot duty and an imprinting energy will be examined.

The following thin-film type thermal heads, designated as 4e and 4h and each having a resolution of 300 DPI, were mounted to the thermal stenciling device and stenciling was performed with dot duties of 1×1, 2×2, and 3×3 to stenciling papers designated as 1a and 1d.

Thermal head 4e:
Dot size (μm): 65 (main-scanning direction)×77 (sub-scanning direction);
Dot area (μm²): 5005;
Resistance (Ω): 670;
Applied power (w/mm²): 40 (0.200 w/dot); and
Applied energy (mJ/mm²): 60.
Thermal head 4h:
Dot size (μm): 48 (main-scanning direction)×42 (sub-scanning direction);
Dot area (μm²): 2016;
Resistance (Ω): 500;
Applied power (w/mm²): 40 (0.081 w/dot); and
Applied energy (mJ/mm²): 60.
Stencil paper 1a:
Thermoplastic resin film:
Material: polyethylene terephthalate (PET),
Thickness (μm): 1.8,
Melting point (°C.): 214; and
Porous carrier:
Material: PET fiber,
Thickness (μm): 40.
Stencil paper 1d:
Thermoplastic resin film:
Material: polyethylene terephthalate (PET),
Thickness (μm): 1.8,
Melting point (°C.): 252; and
Porous carrier:
Material: Manila hemp,
Thickness (μm): 38.

Then, four kinds of perforated stencil samples obtained by the combinations of (4e-1a), (4e-1d), (4h-1a) and (4h-1d) were fixed to an ink pad and an imprinting load and an imprinting time were set to 1, 5 and 9 kgf and 1, 5 and 9 sec, respectively, by using a compression and tension tester to prepare nine kinds of imprinted samples for each combination (Mitsubishi PPC was used as the printing paper).

Shown in FIGS. 21A to 24C is the relationship between the bleeding rate and the imprinting energy obtained by the above four combinations of the stencil papers 1a and 1d and the thermal heads 4e and 4h in relation to the differences in the dot duty.

Figure 25:
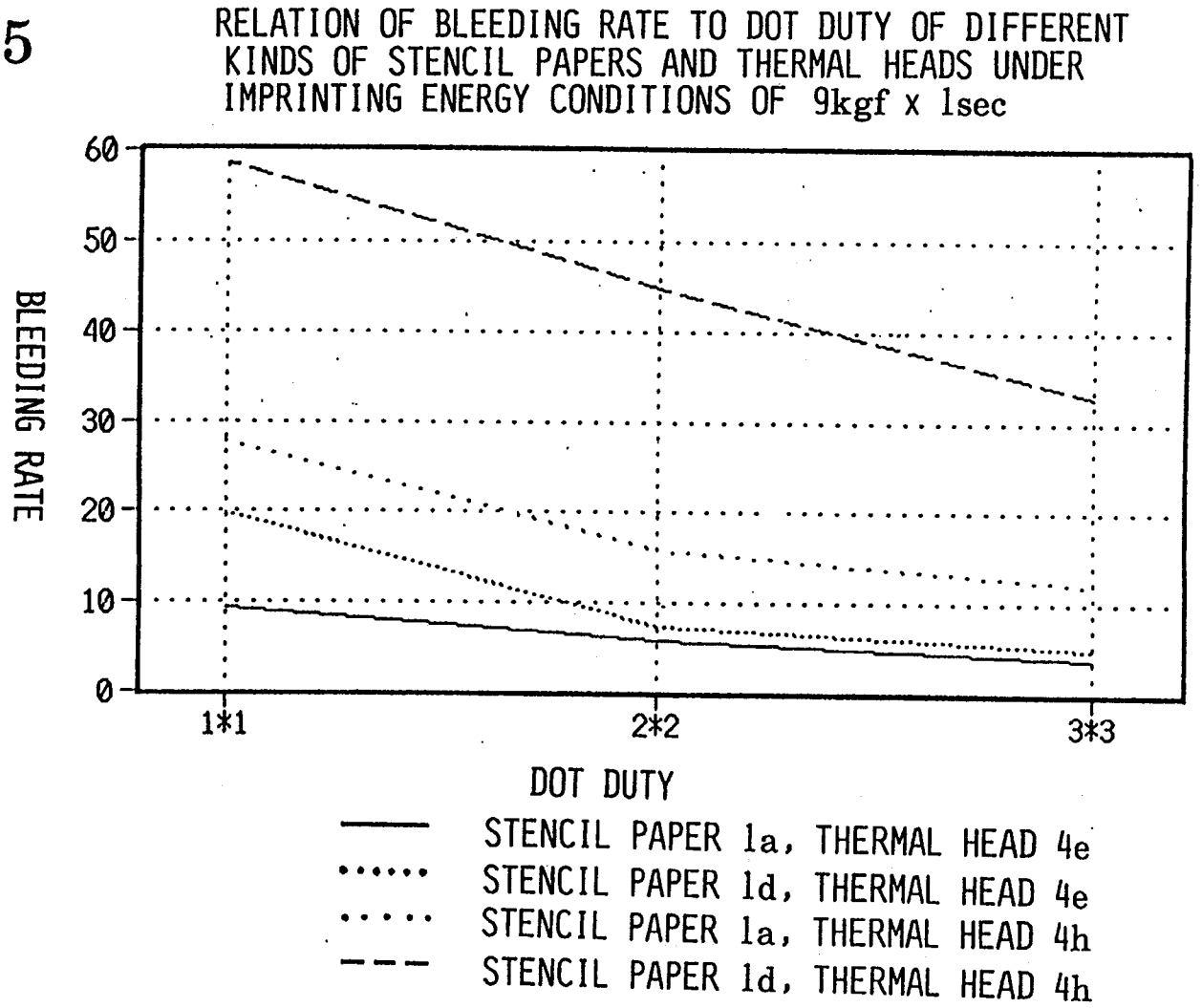
FIG. 25 is a graph showing the relationship between the bleeding rate and the dot duty in the four combinations.

Further shown in FIG. 25 is the relationship between the bleeding rate and the dot duty in the four combinations of the stencil papers 1a and 1d and the thermal heads 4e and 4h under the imprinting energy conditions (the imprinting load of 9 kgf and the imprinting time of 1 sec) which will provide a good print quality.

As apparent from FIGS. 21A to 24C and 25, the bleeding rate in the stencil paper 1d employing Manila hemp as the material for the porous carrier is higher than that in the stencil paper 1a employing PET fiber as the material for the porous carrier. Further, the bleeding rate in the thermal head 4h is higher than that in the thermal head 4e, wherein the size of each heat generating element of the thermal head 4h is smaller than that of the thermal head 4e.

As also is apparent from FIG. 25, the bleeding rate is degraded in the order of (1d-4h), (1a-4h), (1d-4e) and (1a-4e).

As also is apparent from FIGS. 21A to 24C, it may be determined that the bleeding rate is almost proportional to the imprinting energy in every combination of the stencil paper and the thermal head and in every dot duty. However, the bleeding rate tends not to be influenced by the imprinting energy in association with an increase in the dot duty.

Figure 26A:
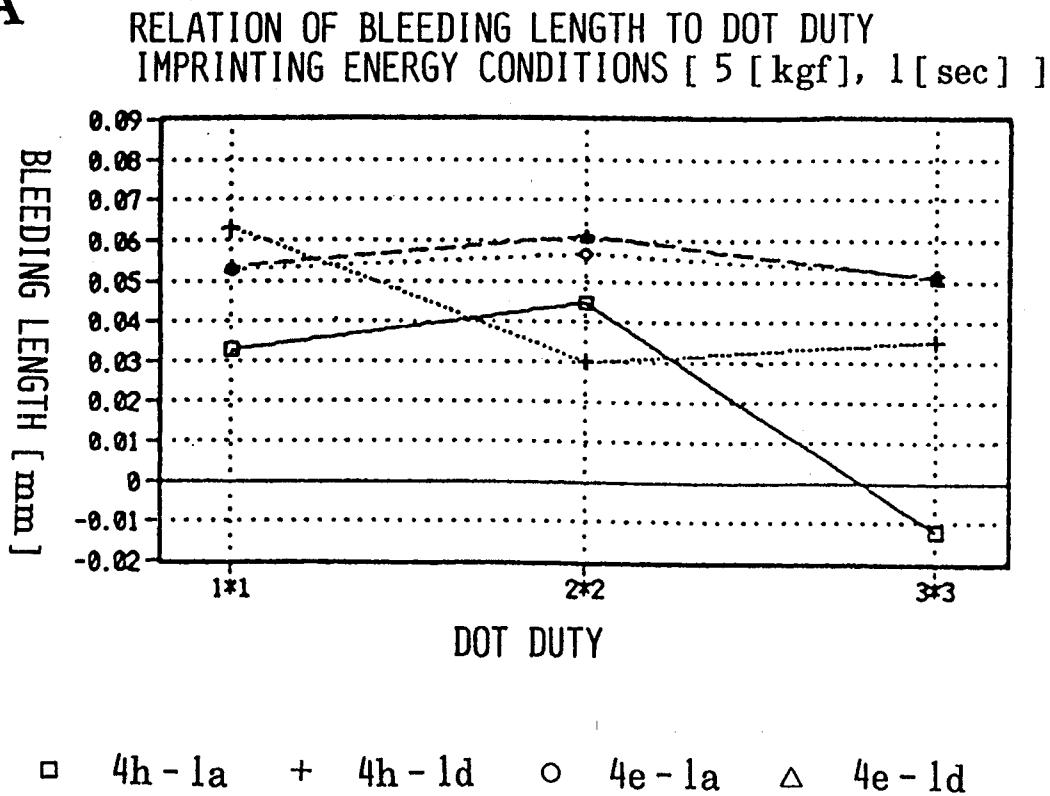
FIGS. 26A, 26B and 26C are graphs showing the relationship between a bleeding length and the dot duty in the four combinations in relation to a difference in imprinting energy.
Figure 26B:
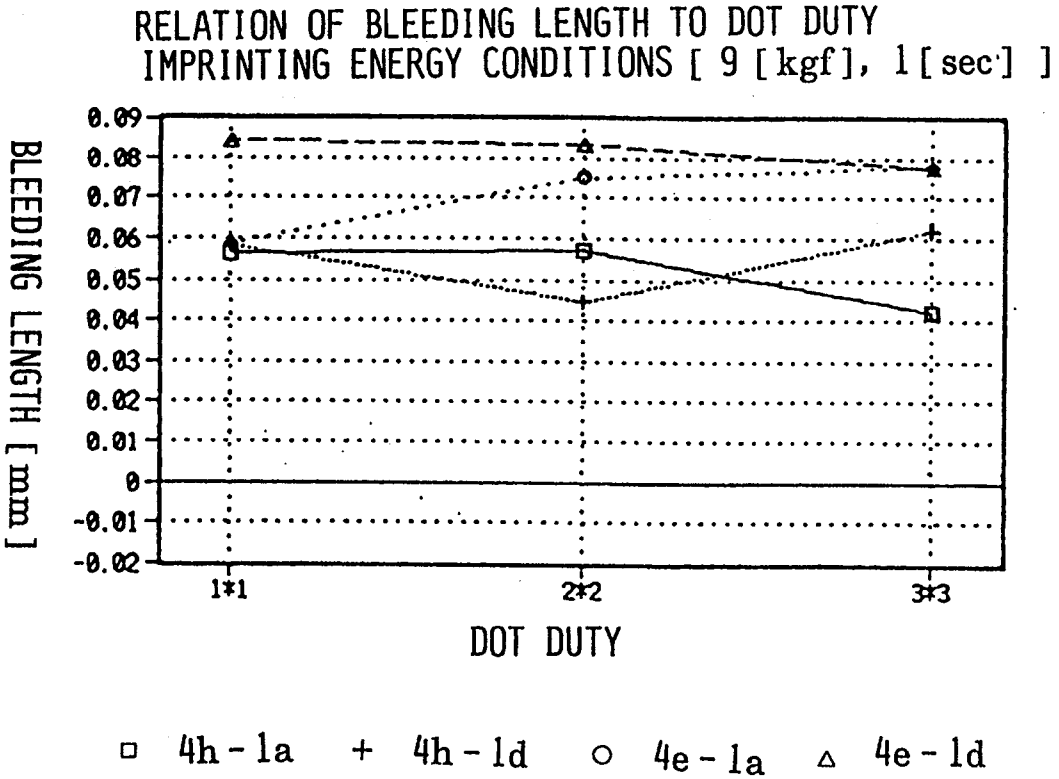
Figure 26C:
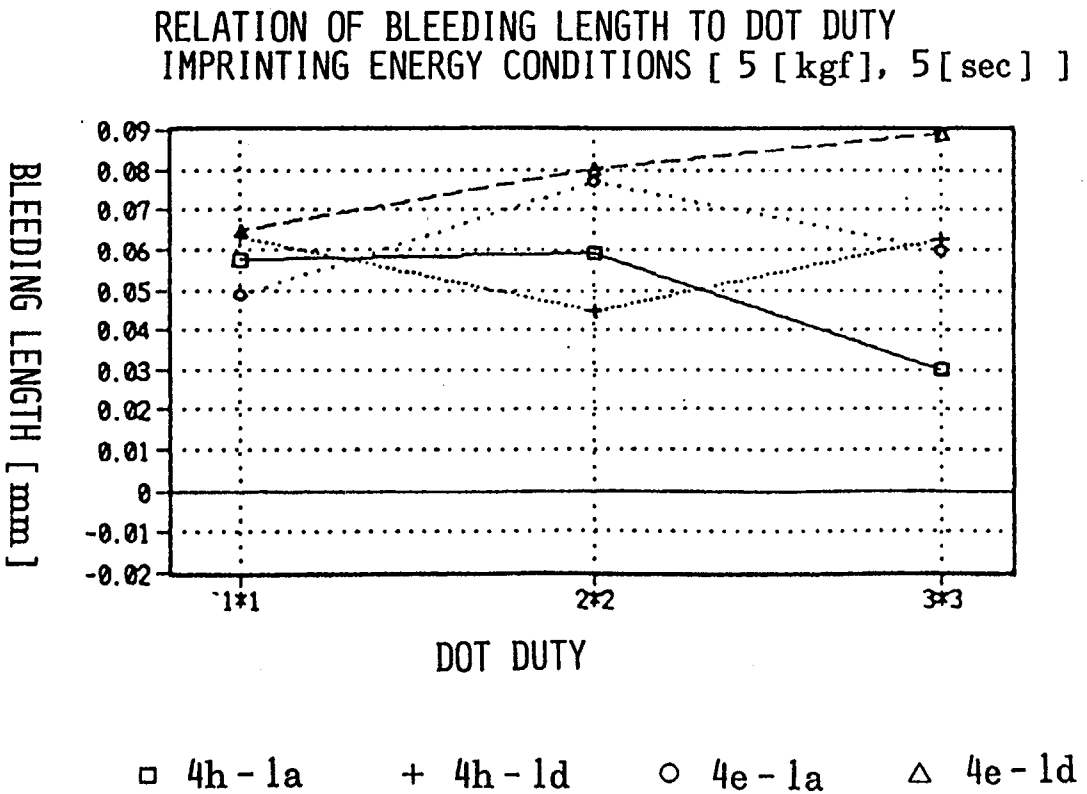
Figure 27:
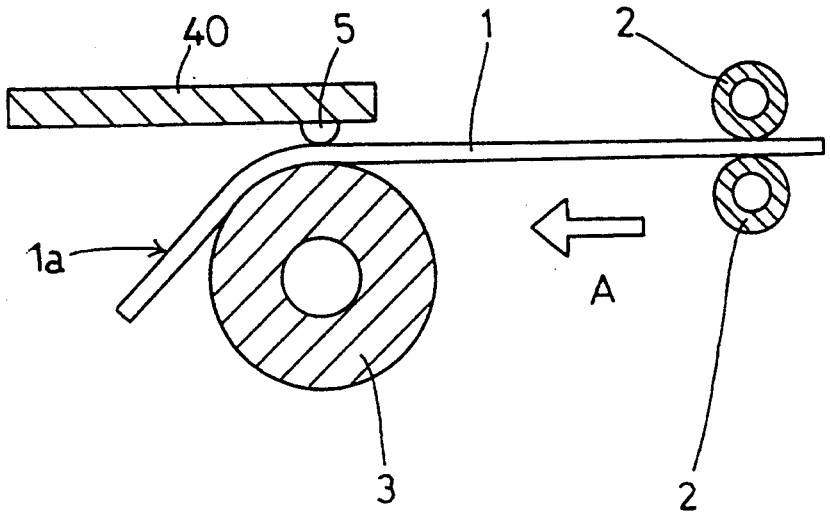
Fig.27 RELATED ART
FIG. 27 is a schematic illustration of a thermal stenciling device in the prior art.
Figure 28:
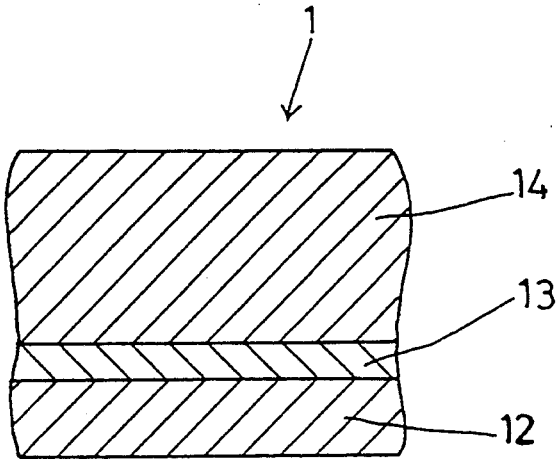
Fig.28 RELATED ART
FIG. 28 is a sectional view of a heat-sensitive stencil paper in the prior art.

There is shown in FIGS. 26A to 26C the relationship between a bleeding length and the dot duty in the four combinations of the stencil papers 1a and 1d and the thermal heads 4e and 4h under three kinds of imprinting energy conditions of (5 kgf×1 sec), (9 kgf×1 sec) and (5 kgf×5 sec) which will provide a substantially good print quality.

As apparent from FIGS. 26A to 26C, the bleeding length is degraded in the order of (1d-4e), (1a-4e), (1d-4h) and (1a-4h). Further, the bleeding length in the stencil paper 1d employing Manila hemp as the material for the porous carrier is larger than that in the stencil paper 1a employing PET fiber as the material for the porous carrier. Further, the bleeding length in the thermal head 4e is larger than that in the thermal head 4h, wherein the size of each heat generating element of the thermal head 4e is larger than that of the thermal head 4h. Further, the bleeding length in the thermal head 4e is constant irrespective of the dot duty.

Consequently, the perforation size is preferably decided from the combination of stencil paper 1, the thermal head 4 and the applied energy E in consideration of the bleeding length, thus introducing Formulas 3 and 4.

As will be appreciated from the above description, the thermal stenciling device in this preferred embodiment can obtain a faithful and stable print image for every original image, suppress and stabilize an ink transfer quantity, and reduce and stabilize the phenomena of undrying, bleeding and back imaging.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. A thermal stenciling device comprising a thermal head constructed of a plurality of heat generating elements arranged in line in a main-scanning direction, the heat generating elements being adapted to be pressed against a thermoplastic resin film bonded to a porous carrier constituting a heat-sensitive stencil paper and be relatively moved in a sub-scanning direction perpendicular to the main-scanning direction to form a plurality of dot perforations through the thermoplastic resin film of the heat-sensitive stencil paper by heat of the heat generating elements; wherein each of the heat generating elements of the thermal head has a size to be decided by the following four formulas:

$A/a:B/b=1:\alpha(\alpha=0.6 \text{ to } 1.0)$;

$A/a=\beta(\beta=0.8 \text{ to } 1.2)$;

$A+C=Pa$; and $B+C=Pb$;

where,

A: length of each perforation in the main-scanning direction;

a: length of each heat generating element in the main-scanning direction;

B: length of each perforation in the sub-scanning direction;

b: length of each heat generating element in the sub-scanning direction;

$\alpha$: ratio of perforation rate in the sub-scanning direction to perforation rate in the main-scanning direction;

$\beta$: the perforation rate in the main-scanning direction;

C: length of a gap as an imperforated portion between the adjacent dot perforations in the main-scanning direction and the sub-scanning direction;

Pa: dot pitch in the main-scanning direction; and

Pb: dot pitch in the sub-scanning direction.

2. A method for determining a size for heat generating elements of a thermal head used for creating stencils, comprising the steps of:

determining a desired length of perforation in each of a main-scanning direction and a sub-scanning direction;

establishing a gap defining a non-perforated portion between adjacent dot perforations in the main-scanning direction and the sub-scanning direction;

generating a dot pitch in the main scanning direction and a sub-scanning direction; and determining a length of the heat generating elements in the main scanning direction and the sub-scanning direction to satisfy the relationship that the length of the perforation in the main-scanning direction divided by the length of the heat generating element in the main scanning direction is in a first range of 0.8 to 1.2 and the ratio of the length of the perforation in the sub-scanning direction divided by the length of the heat generating element in the sub-scanning direction is in a range of 0.6 to 1.0 of a value determined from the first range.

3. The method as claimed in claim 2, wherein the dot pitch in the main scanning direction and the sub-scanning direction is a sum of the gap and the lengths of perforation in the main and sub-scanning directions respectively.

4. The method as claimed in claim 2, wherein the lengths of perforation and the gap are based upon characteristics of a porous backing of a stencil paper, an ink used, and a pressure applied for stencil printing so as to prevent incomplete drying, bleeding and back imaging.

* * * * *